US008256516B2

(12) United States Patent
Rodgers

(10) Patent No.: US 8,256,516 B2
(45) Date of Patent: Sep. 4, 2012

(54) SYSTEM AND METHOD FOR PROVIDING A DOWNHOLE MECHANICAL ENERGY ABSORBER

(75) Inventor: John P. Rodgers, Roanoke, TX (US)

(73) Assignee: Starboard Innovations, LLC, Roanoke, TX (US)

( * ) Notice: Subject to any disclaimer, the term of this patent is extended or adjusted under 35 U.S.C. 154(b) by 330 days.

(21) Appl. No.: 12/469,594

(22) Filed: May 20, 2009

(65) Prior Publication Data

US 2010/0132939 A1 Jun. 3, 2010

Related U.S. Application Data

(60) Provisional application No. 61/128,458, filed on May 20, 2008.

(51) Int. Cl.
*E21B 17/07* (2006.01)
*E21B 29/00* (2006.01)
*F16F 7/12* (2006.01)

(52) U.S. Cl. ..... 166/297; 166/55; 166/242.7; 166/376; 175/321; 188/376; 188/377; 267/137

(58) Field of Classification Search ..... 166/55, 166/177.6, 242.6, 242.7, 250.01, 297, 376; 175/50, 305, 315, 321; 188/371, 376, 377; 267/71, 137
See application file for complete search history.

(56) References Cited

U.S. PATENT DOCUMENTS 3,298,465 A * 1/1967 Stastny ..... 188/377
3,323,327 A * 6/1967 Leathers et al. ..... 464/20
3,373,630 A * 3/1968 Heurtebise ..... 74/492
3,660,990 A * 5/1972 Zerb et al. ..... 464/20
4,173,130 A * 11/1979 Sutliff et al. ..... 464/7
4,194,582 A * 3/1980 Ostertag ..... 175/321
4,211,290 A * 7/1980 Mason et al. ..... 175/321
4,665,978 A 5/1987 Luke
4,693,317 A * 9/1987 Edwards et al. ..... 166/378
4,817,710 A * 4/1989 Edwards et al. ..... 166/242.7
5,088,557 A 2/1992 Ricles et al.
5,131,470 A * 7/1992 Miszewski et al. ..... 166/297
5,366,013 A * 11/1994 Edwards et al. ..... 166/297
6,092,593 A 7/2000 Williamson et al.
6,109,355 A * 8/2000 Reid ..... 166/380
6,206,155 B1 * 3/2001 Schneider ..... 188/376
6,308,940 B1 * 10/2001 Anderson ..... 267/125
6,454,012 B1 * 9/2002 Reid ..... 166/381
6,708,761 B2 * 3/2004 George et al. ..... 166/297
7,044,219 B2 * 5/2006 Mason et al. ..... 166/242.1
7,086,480 B2 8/2006 Simpson et al.
7,779,907 B2 * 8/2010 Wagner et al. ..... 166/169
2003/0089497 A1 * 5/2003 George et al. ..... 166/297
2004/0140090 A1 * 7/2004 Mason et al. ..... 166/242.1
2004/0163823 A1 8/2004 Trinder et al.
2005/0217898 A1 * 10/2005 Clark ..... 175/56
2005/0269074 A1 12/2005 Chitwood
2006/0118297 A1 * 6/2006 Finci et al. ..... 166/242.1
2010/0132939 A1 * 6/2010 Rodgers ..... 166/244.1

OTHER PUBLICATIONS

Notification of Transmittal of the International Search Report and the Written Opinion of International Searching Authority, or the Declaration dated Jan. 12, 2010 in connection with International Patent Application No. PCT/US09/44750.

* cited by examiner

*Primary Examiner* — Jennifer H Gay

(57) ABSTRACT

A system and a method provide a downhole mechanical energy absorber that protects downhole tools from impact loads and shock loads that occur during run-in contacts, tool drops, perforating blasts, and other impact events. A continuous localized inelastic deformation of a tube is a primary energy absorber in a load limiting design of the downhole mechanical energy absorber.

49 Claims, 18 Drawing Sheets

SYSTEM AND METHOD FOR PROVIDING A DOWNHOLE MECHANICAL ENERGY ABSORBER

PRIORITY CLAIM TO PROVISIONAL PATENT APPLICATION

This patent application claims priority to U.S. Provisional Patent Application Ser. No. 61/128,458 filed on May 20, 2008.

TECHNICAL FIELD OF THE INVENTION

The present invention is generally directed to the manufacture of tools for the oil and gas producing industry and, in particular, to a system and method for providing a mechanical energy absorber that may be advantageously used in a downhole environment.

BACKGROUND OF THE INVENTION

Downhole mechanical energy absorbers can be used to protect equipment in a wellbore from dynamic loads that can arise from several sources. These sources include impacts that occur during tool run-in or that occur when tools are dropped into the wellbore. The source of the mechanical load can also be an explosive blast such as the detonations that occur during perforation operations.

The dynamic loads may vary greatly in scale of magnitude and in duration. For example, a blast load may have peaks of less than a millisecond and may induce forces of hundreds of thousands of pounds. A tool drop impact may have a slower onset but may perhaps have an even larger total kinetic energy. On the opposite end of the load spectrum, a longer duration loading event may have a gradual onset, such as when weight is set down on a tool string.

The function of a mechanical energy absorber is to absorb mechanical energy and convert kinetic energy into heat and into a controlled material deformation. In doing so, the loads that affect the tool string can be limited in magnitude. In this manner a mechanical energy absorber is both an energy absorber and a load limiter. In some downhole applications, limiting peak loads in the tool string is the primary objective of the absorber. This may also include buckling prevention. In other downhole applications, the objective may be to protect sensitive equipment within the tools, such as electronics, from high acceleration levels or shock loads. In all cases, the wellbore diameter is a major design constraint.

Many different types of mechanical energy absorbers have been developed over the past half century. Mechanical energy absorbers (also referred to as shock absorbers) have been used not only in downhole applications but also in aircraft and ground vehicles to provide protection for passengers and sensitive cargo. Many of the designs for vehicles, particularly in the aerospace industry, focus on optimizing a specific energy absorbed, where weight is a penalty. The objective of these designs is to reduce acceleration magnitude and duration to improve survivability.

The ideal linear-motion mechanical energy absorbers provide a constant load during their stroke. This load may be set to a maximum allowable level without causing damage to the systems being protected. For the ideal constant load design, the mechanical energy absorber exhibits a near zero spring-rate during its stroke. Low noise or ripple during the stroke also reduces shock loads transferred across the device.

In order to operate over the full range of downhole loading conditions, a device must be able to handle very rapid onset of force as well as handle high levels of energy absorbed. The inelastic deformation of metals has been demonstrated to be one of the best performing and most versatile and reliable means of absorbing significant mechanical energy in a continuous and uniform fashion. Because wellbore conditions and tool string geometry vary greatly, it is imperative to have a design that can be readily adapted to meet the specific requirements of each job.

Some of the simplest energy absorbers rely primarily on the elastic compression of springs or elastomeric elements. The problem with these designs is that the force is not constant but rather increases during the stroke, and the energy is only stored temporarily and thus is not truly absorbed. This results in a rebound with similar potentially damaging effects as the original shock. Performance can also change significantly with temperature.

Other designs have utilized discretized energy absorbing elements that sequentially engage to absorb energy. Each element absorbs energy only over a small portion of the total stroke of the device. The drawback of such concepts is that the load level is still not constant and will have a significant ripple or noise level.

Other designs rely on frictional forces to dissipate energy as heat. The drawback of these concepts is also a non-constant load level and a build up of heat that can lead to damage and performance degradation, particularly in a long-stroke application.

Fluid-based concepts for dissipating energy typically force a fluid through an orifice similar to automotive shocks used between the wheel or axle and the vehicle frame. These devices depend upon viscous damping and fluid shear and are highly rate-dependent and are not feasible for high rate impact or ballistic shocks. At high rates, the fluid flow cannot respond to the rapid load onset causing the forces to escalate with minimal stroke.

Applications involving vibration isolation, vibration damping, or small-amplitude wave attenuation are not directly relevant. Designs for such applications cannot absorb energy on the scale required for the intended impact and shock events described here. Instead, these designs typically focus on protecting electronics from long duration vibratory loads such as those generated while drilling.

Prior art downhole mechanical energy absorbers include the following:

U.S. Pat. No. 3,653,468 is one of the earlier downhole shock absorbers and utilizes sequential shearing of metal disks or washers to absorb energy.

U.S. Pat. No. 4,679,669 cuts chips from a mandrel using shearing cutters fixed to the housing, similar to machine tools such as on a lathe.

U.S. Pat. Nos. 5,131,470 and 5,366,013, as well as U.S. Pat. App. 2006/0118297, describe honeycomb crushing along with a damping coil for shock absorption.

U.S. Pat. No. 5,188,191 utilizes alternating metal and rubber layers to provide an impedance mismatch for reducing shock transmitted.

U.S. Pat. Nos. 6,109,355 and 6,454,012 describe a frictional interference fit with elastic deformation for energy absorption. The patents describe a uniform deformation of the tool housing with hoop stress being the primary design metric. The deformation may also be inelastic for one-time use applications.

U.S. Pat. No. 6,708,761 employs the sequentially shearing of radially-oriented metal elements, or shear pins, to absorb energy during a linear stroke.

U.S. Patent Application Publication No. 2003/0150646 uses a porous material to absorb shock loads.

U.S. Patent Application Publication No. 2004/0140090 transfers shock energy to a spring-mass system.

A more extensive history of continuously deforming or rupturing metal for energy absorption can be found outside of the oil and gas producing industry. These devices are intended for absorbing energy from the relative motion between vehicles, between vehicles and the environment, or occupants and the vehicles themselves.

U.S. Pat. No. 3,143,321 describes the continuous rupturing of a tube forced onto a die. Similar concepts were also described in NASA technical report NASA TN D-5730.

Another NASA report, NASA TN D-4941, describes a tube cutter design that cuts a tube into longitudinal strips to absorb energy for a landing gear strut. A similar approach is used in U.S. Pat. No. 5,547,148.

U.S. Pat. No. 3,394,612 utilizes interference between telescoping tubes such that the outer tube is deformed by embossments on the inner tube for a vehicle steering column energy absorber.

U.S. Pat. No. 3,779,591 uses fixed cutters to shear away material from a moving mandrel.

Similarly, U.S. Pat. No. 4,346,795 uses a cutting ring to shear away the entire circumference of the mandrel surface.

U.S. Pat. No. 4,575,026 describes a continuous plastic deformation of metal to decelerate a vehicle on a track.

U.S. Pat. No. 5,351,791 discloses a tube pushed through a reducing die and a crushing element.

U.S. Pat. No. 6,135,252 relies on metal extrusion for energy absorption.

U.S. Pat. Nos. 6,308,809 and 6,457,570 introduce stress concentrators to control the rupture of a tube.

U.S. Pat. No. 7,147,088 describes the controlled collapse of thin-walled tubes in a multi-stage design.

U.S. Pat. No. 6,371,541 shear cuts material from a metal structure with guides to control the direction of the progression.

U.S. Pat. No. 6,394,241 applies a combination of shearing and bending to absorb energy for crashworthy seats. The inventor, Desjardins, also published a history and summary of energy absorbers used for crashworthy seats in an American Helicopter Society (AHS) presentation and paper (AHS 59$^{th}$ Annual Forum, May 2003).

SUMMARY OF THE INVENTION

The novel and unique design of the present invention overcomes the deficiencies of the prior art for downhole mechanical shock absorbers. The present invention (1) maximizes the limit load achievable in a constrained cross-section of the downhole tool; (2) provides a long stroke for absorbing large amounts of kinetic energy; (3) provides a constant force (near zero effective stiffness) with low noise in a smooth continuous fashion to minimize the shock loads transferred; (4) avoids chips or metal cuttings that could take up valuable space or jam the relative motion; (5) provides the toughness needed for surviving and performing under downhole and ballistic shock and impact conditions; (6) is readily adapted to meet the specific job requirements; and (7) offers the opportunity to reduce manufacturing tolerances and material costs for a low-cost system.

The present invention utilizes the continuous deformation of a tubular element or array of elements to absorb kinetic energy. As a result of external loading, a rigid or deforming element moves slidably and coaxially relative to a deformable element in order to cause the deformation. An external housing encloses the deforming element. In a first advantageous embodiment, the deforming element is a modified tube engaging internal and/or external cutting/deforming teeth. These teeth serve a dual-role as a die to force localized inelastic deformation in the tube wall and also a cutter to force rupture or tearing of the wall. The sacrificial or frangible tube is provided with stress concentrations and/or guides to control both the initiation and the propagation of the deformation zone along the axis of the tube.

The present invention provides a great deal of adaptability to different downhole applications and conditions via simple changes to the sacrificial tube and cutting teeth. Changes to the limit load, the stroke, and the rise time or load-up time can be effected to match the anticipated dynamic load characteristics and requirements for the protection of sensitive tools in the wellbore or to maintain tool string integrity. Having a deformable element that is separate from the primary structures, the inner mandrel and outer housing, is significant for achieving the advantages of adaptability and ease of manufacture. More details on the specific means of varying design parameters will be provided below.

In a second advantageous embodiment, the deforming member is a cone and the deformable element is an array of axially oriented elements that fit in the annulus between the deforming member and an external housing. The array of elements does not completely fill the annular cross section with solid material but rather has open spaces to allow for bending and shear deformation as the cone engages. The array may be joined with welds or a frame. The geometry of the deformable elements can be selected from a wide range of commercially available or custom tubular or beam materials and geometries to tailor the deformation behavior and energy absorbed per unit length of stroke. As an example, the array may consist of small steel tubes having a diameter no greater than the initial radius gap between the inner mandrel and outer housing. The array may also include a combination of elements having more than one material type and geometry. The elements are preferably selected to individually engage the cone with a line contact but may also contact over a broader area. The elements may also be embedded in a matrix or compressible filler.

The present invention is also modular and stackable and has a two-way stroke capability. In one advantageous embodiment, the device can be a compressive energy absorber. Another advantageous embodiment operates as a tensile energy absorber, and a third advantageous embodiment would include both tension and compression energy absorbers.

The modular energy absorbing elements can be stacked on a common mandrel to increase the limit load or can be stacked to operate as independent absorbers to increase the effective stroke. Multiple distributed shock absorbers can be employed in a tool string to optimize performance. Each shock absorber can be set to a unique load and stroke characteristic. A dynamic simulation of a tool string can be used to determine optimal placement and sizing of the absorbers.

The present invention maintains structural integrity after stroking so that the tool string can be removed after an impact or blast. If necessary, inadvertent stroking during tool run-in can be locked out with shear pins. This maintains an accurate tool string length to ensure placement of guns or other tools on depth. The shock absorber tool has a central bore that can serve as a flow passage or a passage for detonation cord or wiring.

In an alternate advantageous embodiment primarily for perforating applications, the shear pins that lock the shock absorber during run-in are replaced with a controlled frangible element that breaks a structural connection to free up the shock absorbing element once the guns are located on depth.

This can offer the benefit of improved performance by eliminating the initial load required to shear the pins before stroking can commence. Communication to disable the lock may come from a surface device or from another downhole device. The trigger for breaking this lock-out connection can be linked to a drop bar, a telemetry system, a pressure controlled release, a temperature, a time, an acceleration, or a direct link via detonation cord to the primary explosive chain. The trigger may also be a combination of these elements. In yet another advantageous embodiment, the frangible design is replaced with a torque-controlled release, whereby a rotation of the tool string from surface is used to unlock the energy absorber when desired. In another advantageous embodiment, the absorber is activated when the tool string engages a preset downhole device such as a packer.

In some applications it may be advantageous to tailor the load profile over the stroke of the device. The present invention can be tailored for such a load profile by adjusting the sacrificial tube geometry along its length, by using multiple cutting/deforming elements distributed axially to sum their effects, or by combining the primary energy absorber with a secondary absorber that engages in parallel during a portion of the stroke to add to the load for some period. Similarly, in a second advantageous embodiment, the deforming element or element array can be varied along its length by adjusting the lengths and combinations of element materials and geometries.

The apparatus of the present invention is also redressable and most components are reusable. The deformable elements can be removed after use and replaced, leaving the housing, mandrel, and other components for reuse.

In another advantageous embodiment, the apparatus of the present invention is enabled to transfer large torque loads. This may be desirable to allow surface torque and rotation to be used to control other downhole tools in the string.

In another advantageous embodiment, the cutting teeth are oriented radially inward from the mandrel to deform a second inner sacrificial tube. Multiple concentric deforming and deformable tubular elements or arrays can be integrated within a single housing. This may offer an increased limit load capability for a given tool cross section.

In another advantageous embodiment, the cutting teeth are fixed to the outer tool housing and are oriented radially inward to deform an internal sacrificial tube.

In another advantageous embodiment, a locking mechanism is included to increase the resistance to reverse motion after the initial energy absorbing stroke. The locking mechanism may be a spring-loaded engaging lock, a set of wedging slips, or other similar device that restrains relative motion between mandrel and housing. Alternately, the deforming teeth or the deforming cone may be designed such that reverse motion locks the teeth into the sacrificial tube.

In another advantageous embodiment, a two-way absorber enables energy absorption in compression and tension. The reverse lock may be employed to prevent slippage in one unit to allow the other to engage and operate.

Downhole applications for the mechanical energy absorber of the present invention include: protecting other tools, plugs, etc. from blast loading; reducing the loads on perforating gun bodies that result from interaction with the tool string; controlling the buckling of the tool string that may result from dynamic loading events; protecting fixed tools from moving objects in the well, such as drop bars, tool strings, etc., for example, protecting a downhole valve from a falling tool or object; protecting a tool or tool string from impacts with casing or other fixed objects during run-in; protecting sensitive equipment within a tool from impact-related loading. The mechanical energy absorber of the present invention may also protect coiled tubing, wireline, or slickline tool strings from similar loads.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

Before undertaking the Detailed Description of the Invention below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Energy absorption refers to the conversion of kinetic energy into deformation and heat. Deformable element refers to a primary component that is deformed in order to absorb energy. The deformable element is also sometimes referred to as a sacrificial element or a frangible element. Deforming element refers to a component that acts to deform the deformable element. Localized deformation refers to a non-uniform deformation including any one of: tension, compression, bending, and shear of an element cross section as a result of an engagement with a deforming element. Continuous deformation refers to a primarily constant cross section of a deforming element along a tool axis that engages a deformable element and results in a near constant resistance to relative motion.

Inelastic deformation refers to deformation that exceeds elastic limits or the yield strength of a material. Tubular member refers to a generally cylindrical object that is hollow but may have a non-circular, complex geometry. Load limiter refers to the limiting of maximum dynamic loads and the resulting stresses in tool string structures. Stroke refers to the relative motion of the device that results in deformation and energy absorption.

Definitions for certain words and phrases are provided throughout this patent document, those of ordinary skill in the art should understand that in many, if not most instances, such definitions apply to prior uses, as well as future uses, of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

Figure 1A:
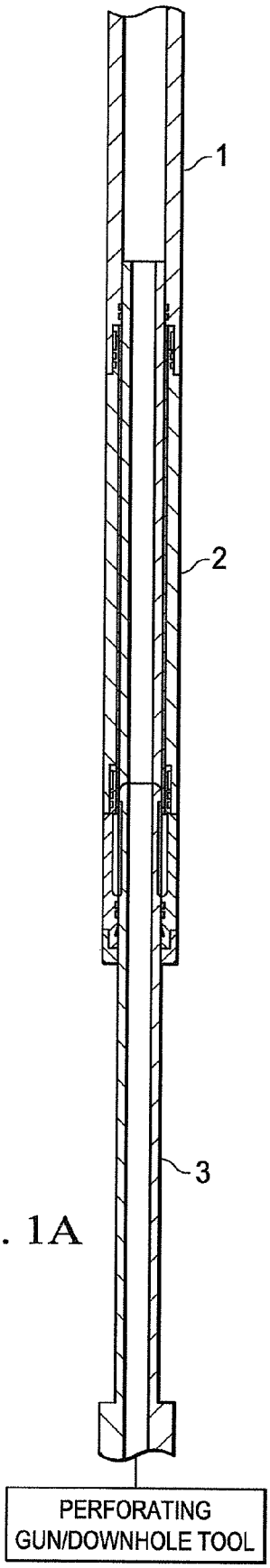
FIG. 1A illustrates a schematic diagram of a mechanical energy absorber tool of the present invention in an initial state.

FIGS. 1 through 29 and the various embodiments used to describe the principles of the present invention in this patent document are by way of illustration only and should not be construed in any way to limit the scope of the invention. Those skilled in the art will understand that the principles of the present invention may be implemented in any type of suitably arranged mechanical energy absorber device.

To simplify the drawings the reference numerals from previous drawings will sometimes not be repeated for structures that have already been identified.

Figure 1B:
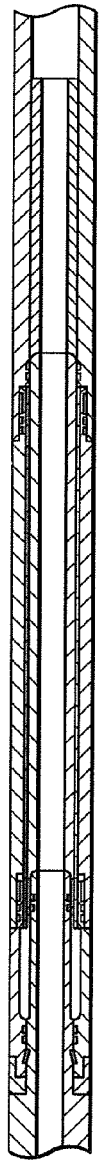
FIG. 1B illustrates a schematic diagram of a mechanical energy absorber tool of the present invention in a compressed state.
Figure 2:
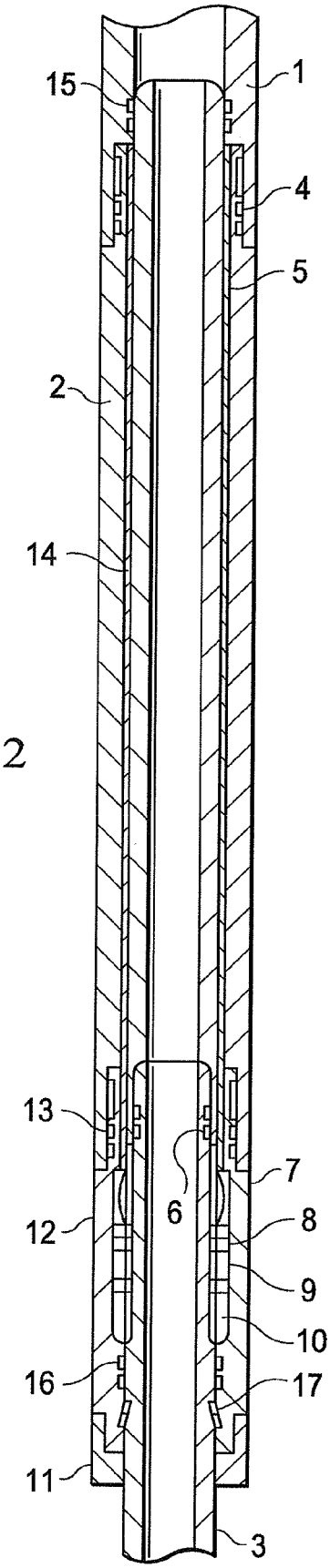
FIG. 2 illustrates a more detailed view of the mechanical energy absorber tool of the present invention showing some of its internal components.
Figure 3:
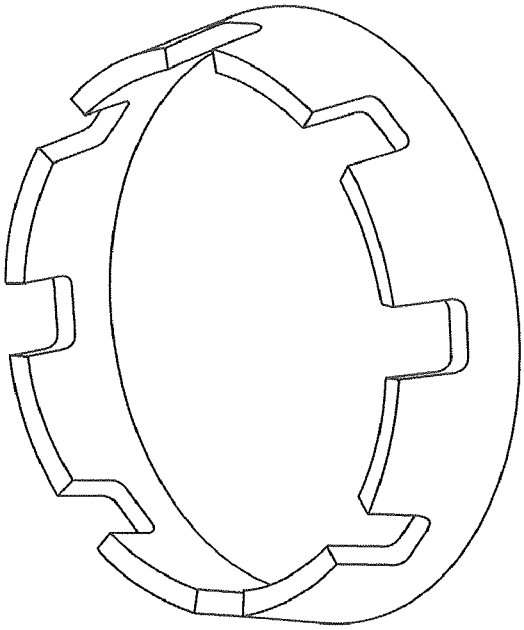
FIG. 3 illustrates a tabbed compression ring for carrying tensile loads.
Figure 4:
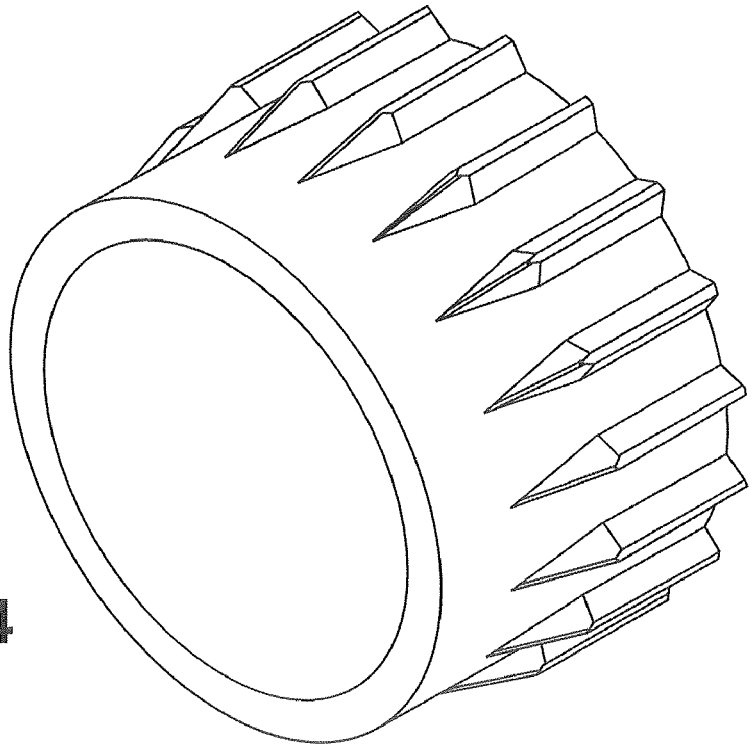
FIG. 4 illustrates a cutting ring.
Figure 5:
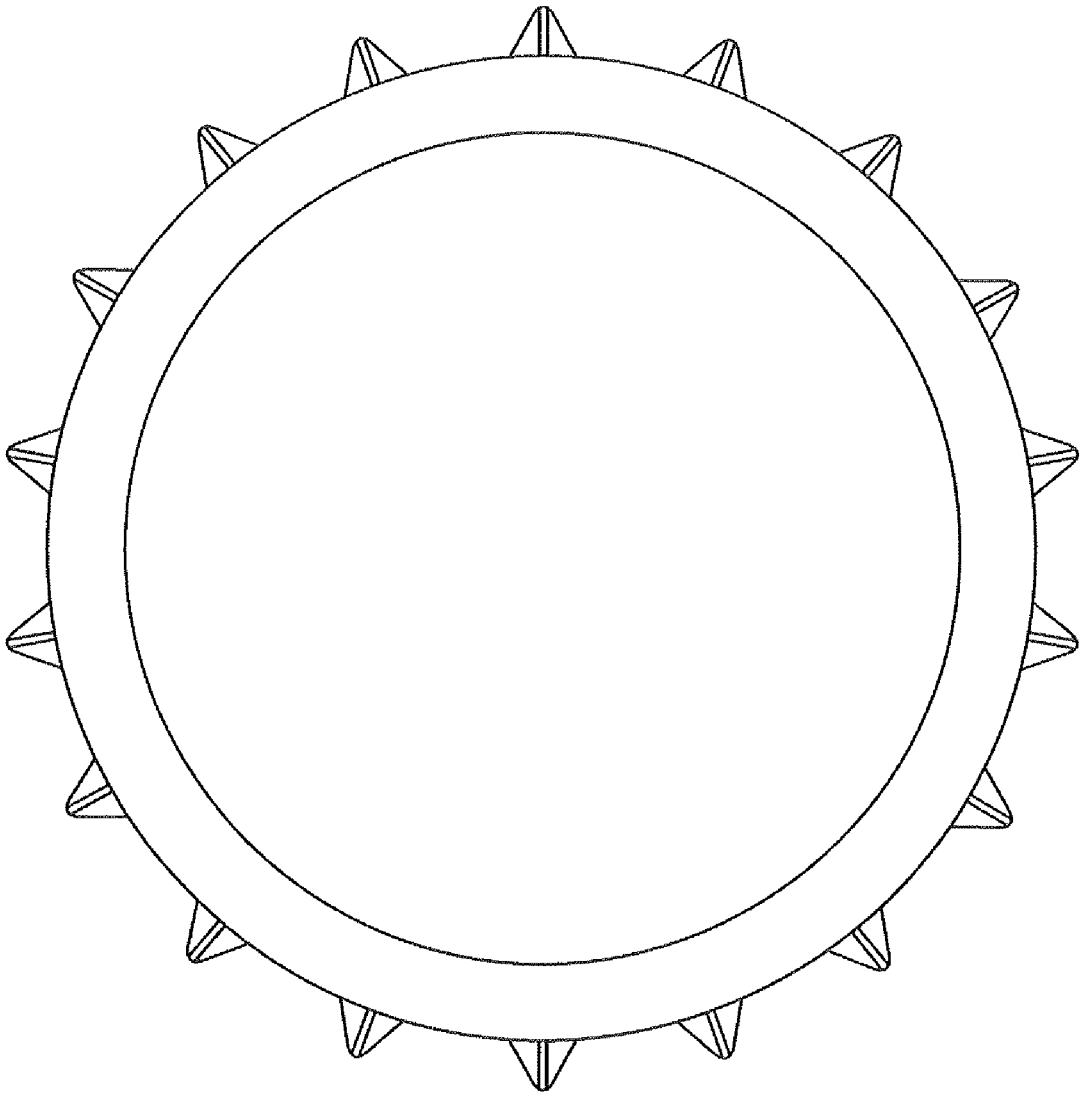
FIG. 5 illustrates an end view of the cutting ring that is shown in FIG. 4.
Figure 6:
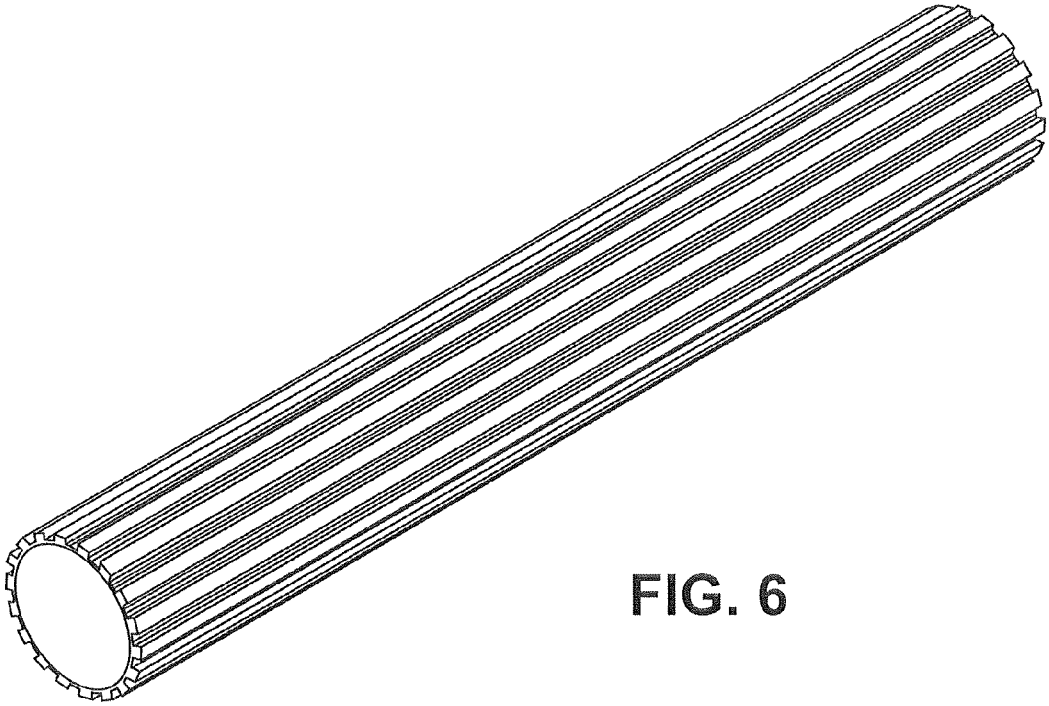
FIG. 6 illustrates a sacrificial tube.
Figure 7:
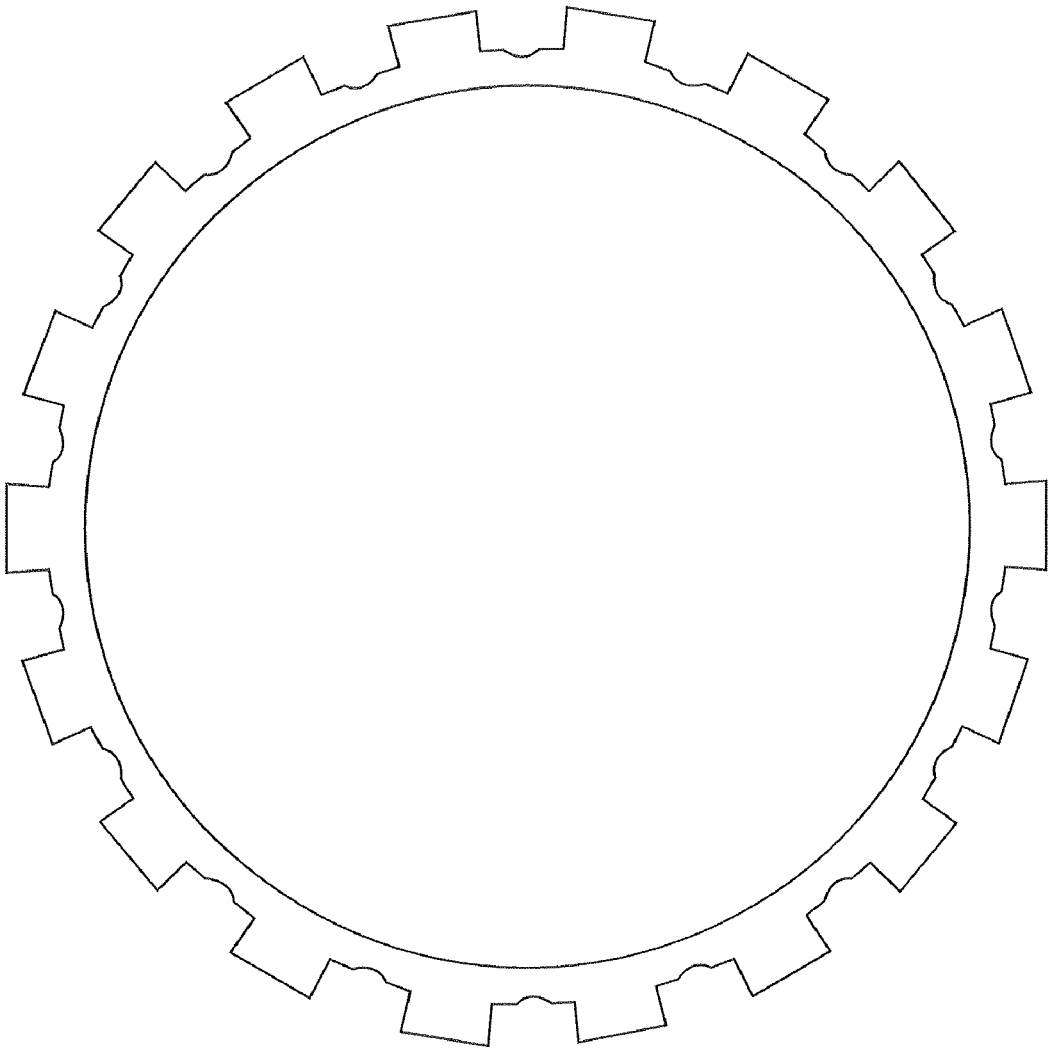
FIG. 7 illustrates an end view of the sacrificial tube that is shown in FIG. 6.
Figure 8:
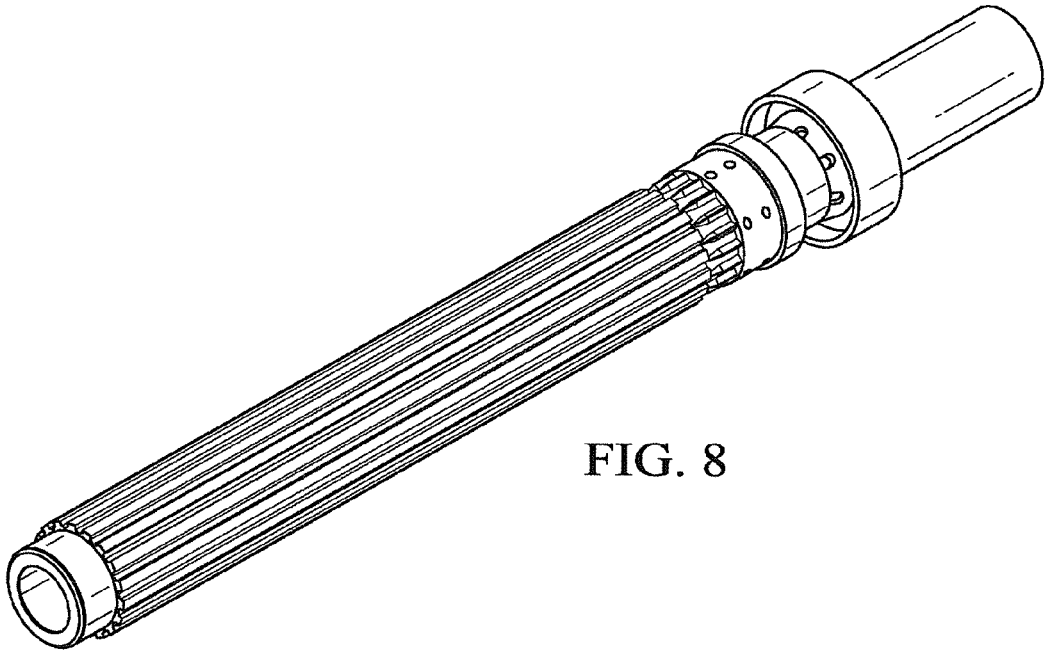
FIG. 8 illustrates a mechanical energy absorber tool of the present invention with its housing removed.
Figure 9:
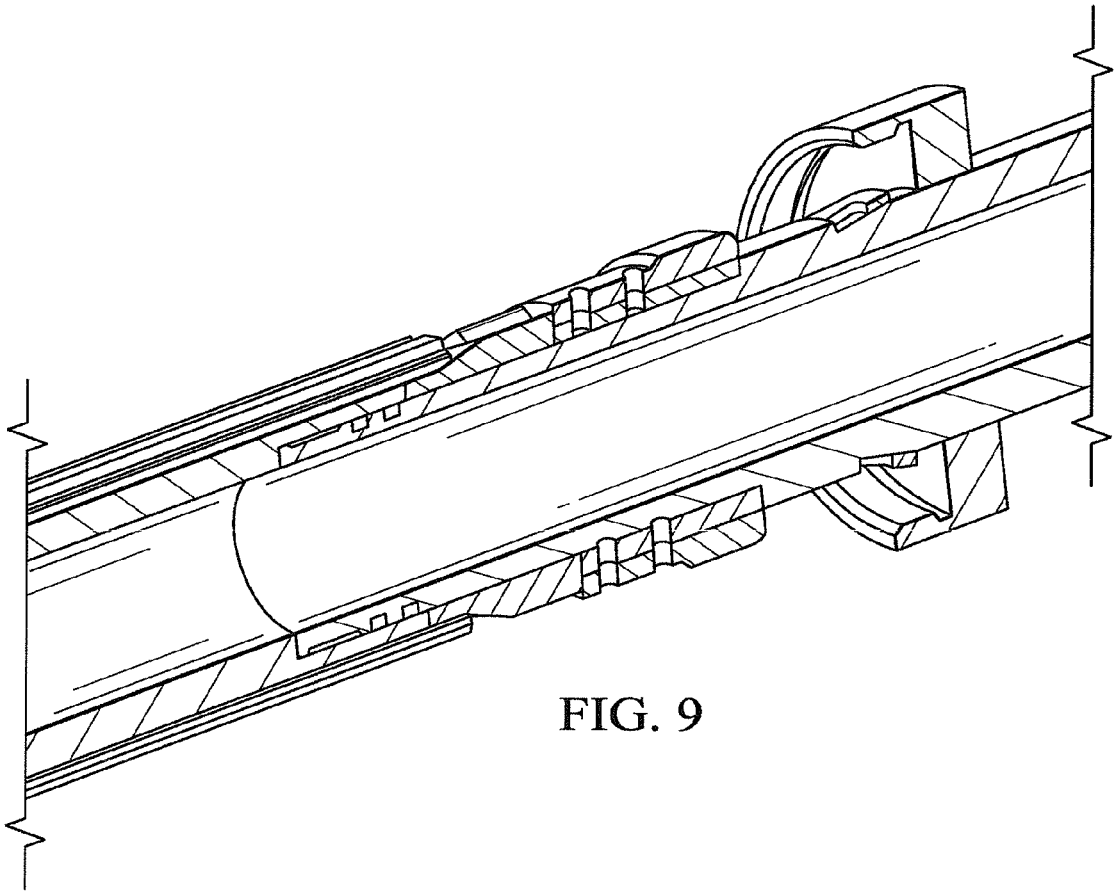
FIG. 9 illustrates a cross sectional view of a mechanical energy absorber tool of the present invention with its housing removed.
Figure 10:
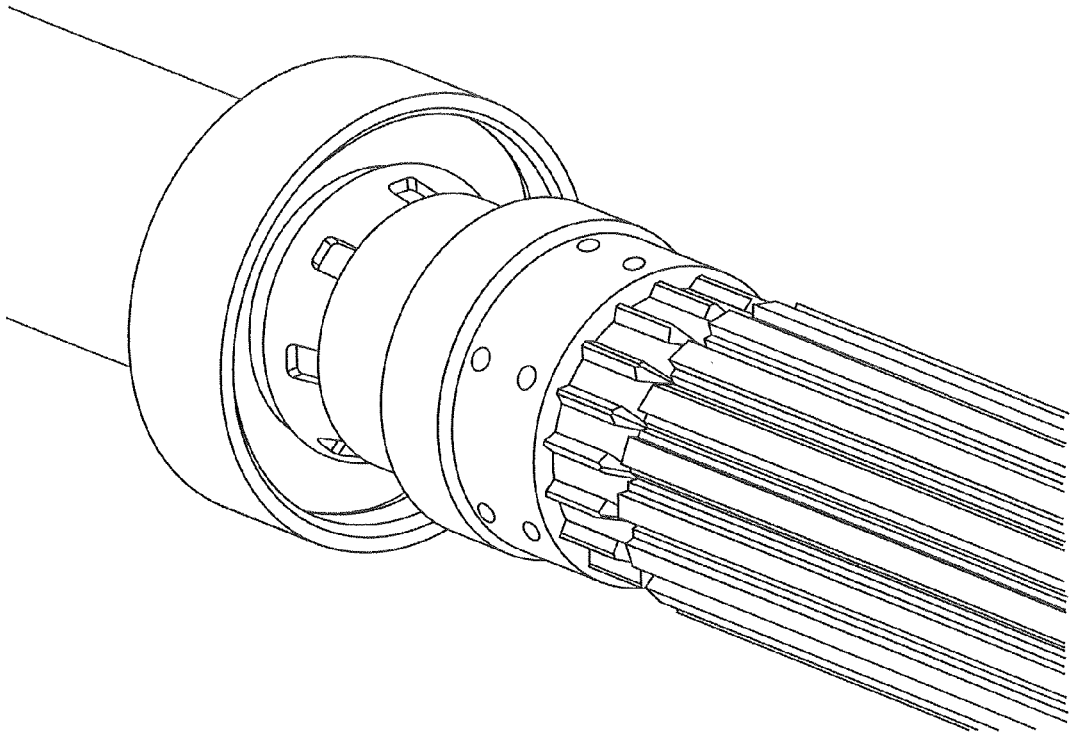
FIG. 10 illustrates another view of the mechanical energy absorber tool of the present invention with its housing removed.
Figure 11:
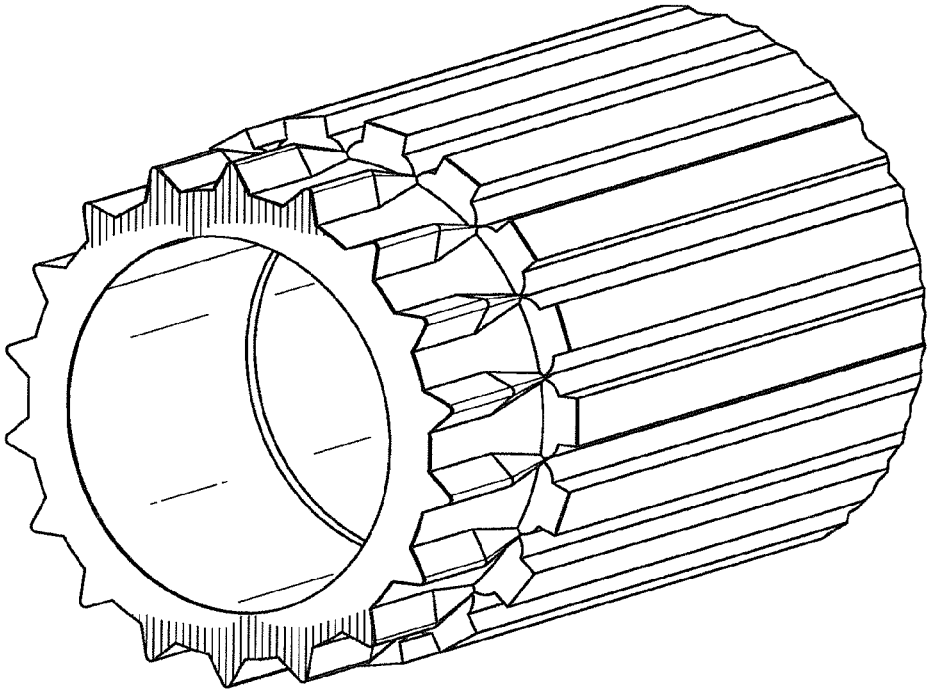
FIG. 11 illustrates a cutting ring engaging a sacrificial tube of the mechanical energy absorber tool of the present invention.
Figure 12:
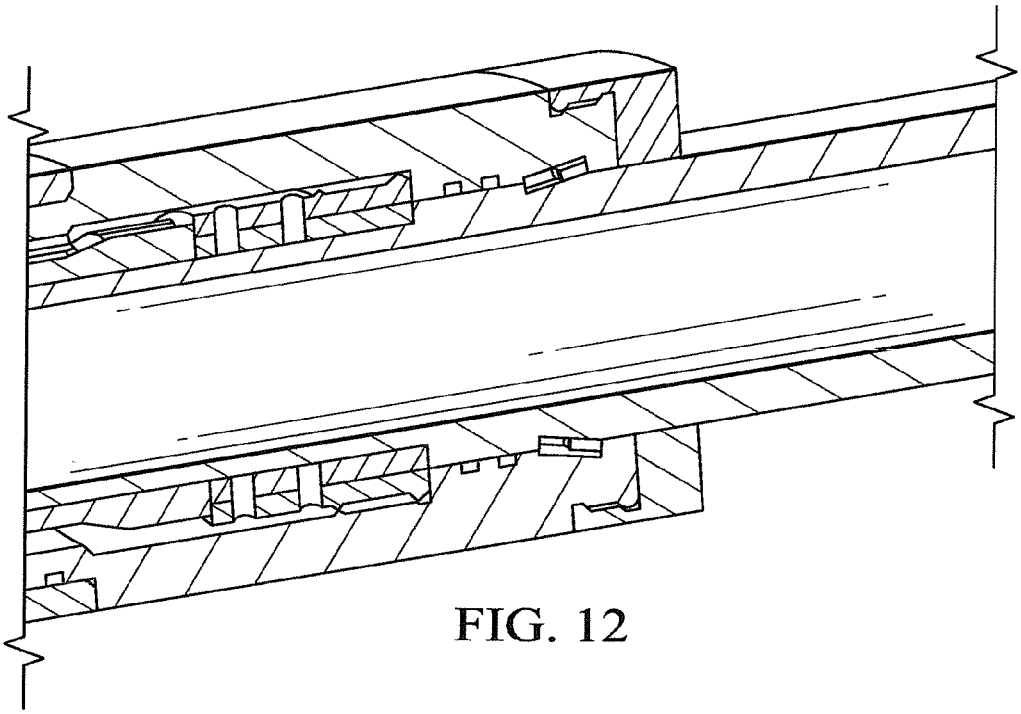
FIG. 12 illustrates a compression ring and shear set of the mechanical energy absorber tool of the present invention.

The following description of a preferred embodiment of a mechanical energy absorber of the present invention refers to FIGS. 1A, 1B and 2. FIG. 1A illustrates a view of the tool assembly in an initial state. FIG. 1B illustrates a view of the tool assembly in a compressed state. The terms leading and trailing are used in reference to the direction of mandrel travel with respect to the housing. The leading housing 1 interfaces the outer structure of the tool with an uphole toolstring. The center housing 2 is connected to the leading housing 1. The trailing mandrel 3 extends downhole from within the center housing 2 and interfaces with a downhole toolstring. As shown in FIG. 1B, after the tool assembly has been compressed, the trailing mandrel 3 enters into the center housing 2, leaving only the downhole toolstring interface exposed.

FIG. 2 provides a more detailed view of the major components of the tool assembly. The outer components of the center housing 2 interface with the uphole tool string. The outer components of the tool assembly comprise the leading housing 1, the central housing 2, and the trailing housing 12. The inner components of the trailing mandrel 3 interface with the downhole tool string. The components of the mandrel comprise the trailing mandrel 3 and the leading mandrel 14. When the tool assembly is compressed, the mandrel components will move upward into the center housing 2. The sacrificial tube 5 is fixed to the outer housing. The cutting element 7 is fixed to the mandrel.

A shear set comprising an inner ring 10, outer ring 9, and shear pins 8 is used to lock out the mechanical energy absorber until some minimum desired load is exceeded. A stopper 11 is included on the lower end of the trailing housing to prevent damage to the tool when a full stroke (i.e., a full compression) is experienced in a mechanical energy absorbing event. Hydraulic seals are included to prevent flooding of the energy absorber and to isolate the external wellbore fluid and any internal flowbore fluids. These seals are included between mating housing components 4 and 13, mating mandrel components 6, and the housing-to-mandrel interfaces 15 and 16. A compression ring 17 is optionally included to provide a stiff load path when the tool is subjected to tensile loads, such as during run-in or pull-out of the tool string.

When subjected to compressive loads, the tabs deform to allow for operation of the mechanical energy absorber. The compression ring 17 is illustrated in greater detail in FIG. 3.

A number of different views of portions of the mechanical energy absorber of the present invention are provided in FIGS. 4 through 17. The cutting element geometry is critical to the function of the mechanical energy absorber of the present invention. The cutting element of the invention is designed to operate under ballistic loads in the extreme which would likely cause failure in prior art tube-cutter designs. The cutting element experiences high stresses during operation as all forces must be transferred through these elements from the mandrel to the sacrificial tube.

The present invention utilizes a robust cutting/deforming element that utilizes a cutting wedge in concert with a deforming boss. As the stroke progresses, the cutter forces material to push radially outward into the open spaces that are placed by design in the outer diameter of the sacrificial tube. The sacrificial tube comprises an alternating pattern of web strips that will be deformed, and rib strips that interface with the housing to provide radial support. As material moves along the cutting element, the outward radial force becomes more narrowly focused to maximize local deformation. A stress concentration groove or score line on the outside of the tube further enhances the local stress due to the cutter and the combination may result in rupture or failure of the tube. The zone of local deformation and possible rupture progresses along the score line as the cutter moves along the tube. The design seeks to reduce frictional forces while maximizing the energy absorbed in the cross-section.

Figure 13:
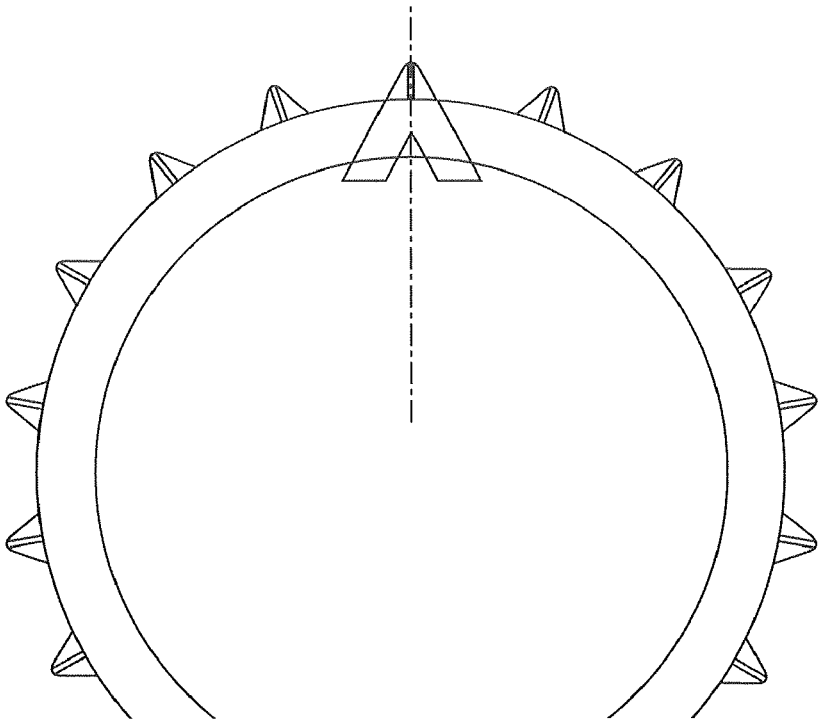
FIG. 13 illustrates angles defining a cutting edge on the teeth of the mechanical energy absorber tool of the present invention.
Figure 14:
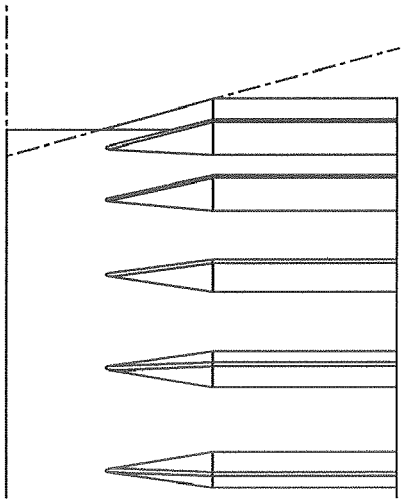
FIG. 14 illustrates an angle defining a leading edge of the cutting teeth of the mechanical energy absorber tool of the present invention.

FIGS. 13 and 14 illustrate the cutting element geometry. The angle of the leading edge of the cutter with respect to the axis is preferably fifteen degrees)(15°) but may be designed over a range of perhaps five degrees)(5°) to thirty degrees)(30°) depending on the exact configuration. This angle is critical to controlling the maximum stresses in the cutter during operation. Transverse to this leading edge, the cutter has a wedge shape with a radius on the leading edge. The wedge angle, measured normal to the leading edge, is preferably plus or minus forty five degrees)(+/−45°). This angle may also be varied over a range. In addition, the cutter may have a rounded profile or other additional complexity that can optimize the stresses in the cutter and cutting performance.

The leading edge has a nominal one hundredth of an inch (0.01") radius to control peak stresses in the tooth. The back edge of the cutter may be designed to resist reverse motion. It may be designed to catch and engage the edges of the material that were deformed during the forward motion. The cutting edge geometry may also be tuned to match the material and geometry selected for the sacrificial tube in a particular application and loading characteristic. The cutting elements may be part of a modular ring component, inserts that directly engage the mandrel, or integral parts of the mandrel. The array of cutting elements may be distributed in a ring or may be distributed with a varying axial offset.

The mandrel is designed to maintain alignment within the sacrificial tube. Ahead of the cutting elements, the mandrel centralizes and supports the sacrificial tube against buckling. Behind the cutting elements, the mandrel is sized to provide internal support to the remnant strips of the sacrificial tube without inducing additional friction.

Figure 15:
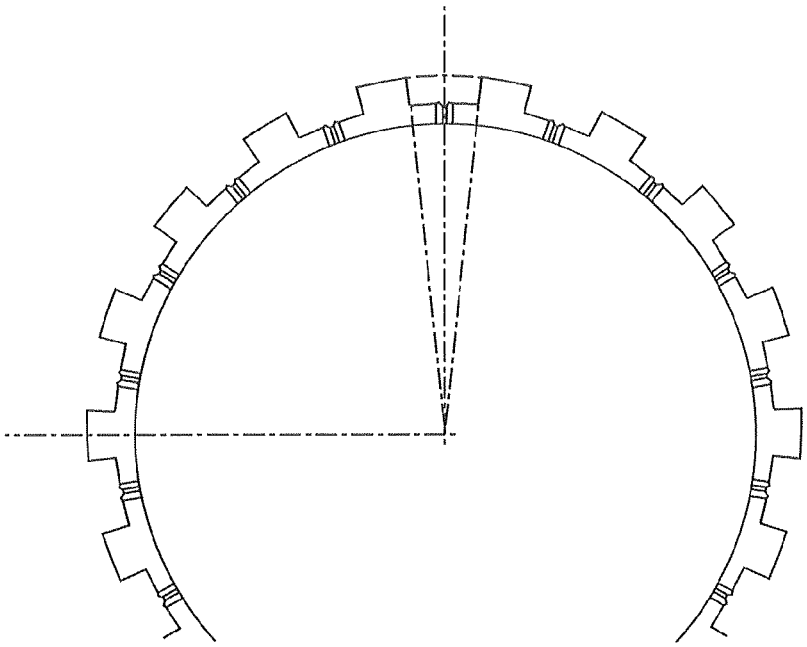
FIG. 15 illustrates an angle defining a width of a deformable sector of a sacrificial tube between ribs of the mechanical energy absorber tool of the present invention.
Figure 16:
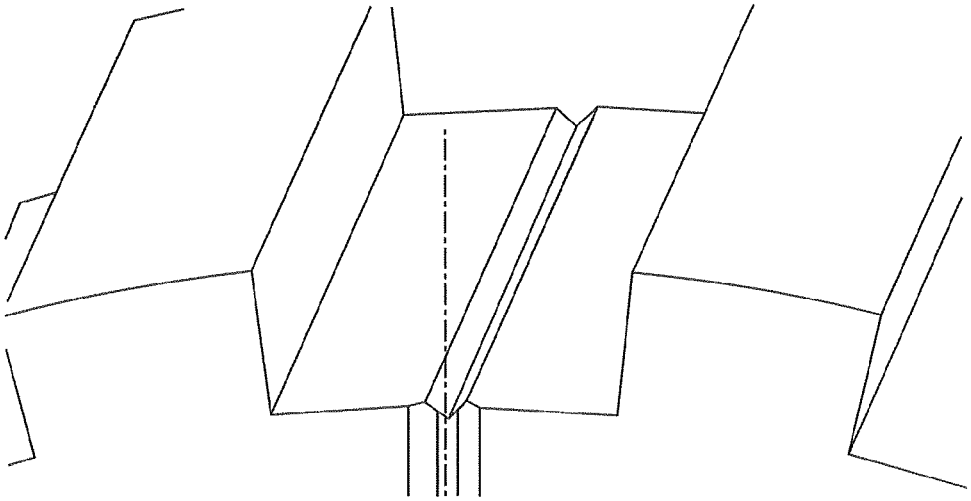
FIG. 16 illustrates a schematic diagram that illustrates a definition of stress concentration groove angle and depth.
Figure 17:
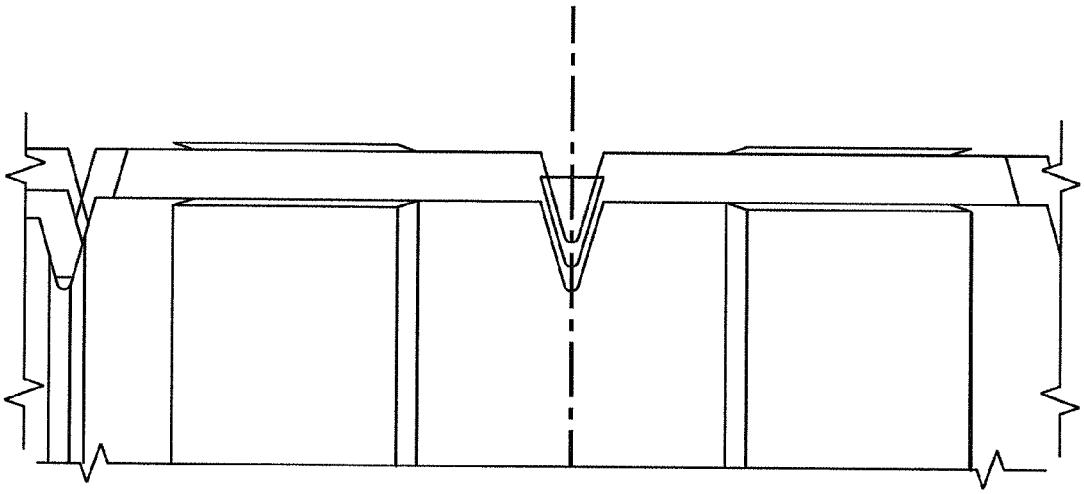
FIG. 17 illustrates a schematic diagram that illustrates a definition of a starting notch including depth, angle, and tip radius.

The sacrificial tube geometry is shown in more detail in FIGS. 15, 16 and 17. The cutters initially engage the end of the sacrificial tube which has been specifically formed to provide a smooth initiation of the cutting process. The stress concentrations in this area have been amplified with deeper cuts so that the force required to rupture the web between ribs is initially less and ramps up rapidly as motion progresses. The thickness of the tube may also be tapered in this region to further control the transition to limit-load operation. The deformation zone will propagate between the ribs and may be further directed and aided by the stress concentration groove or score line. The groove provides a local stress concentration and focuses the peak stresses. The relative width and thickness of the web may be adjusted to optimize energy absorption for a particular material selection and performance objective. Consideration for cutting tooth stress and wear will also factor into the desired web stiffness as defined by the width and thickness. The open space between ribs also provides clearance for the deforming web and a pathway for gas or fluid to bypass the cutter. The geometry of the sacrificial tube may be optimized for a range of shock absorber application requirements.

The sacrificial tube can be loaded in compression or tension within the housing. The cutting mandrel can push through with the trailing end of the sacrificial tube held in tension. Alternatively, the cutting mandrel can be pulled through with the leading end of the sacrificial tube held in compression.

The tool is sealed so that internal components are not subjected to corrosion and to ensure that the stroking (i.e., compression) is not inhibited by viscous or compressibility effects in the fluid. Air flow paths are provided to allow air ahead of the mandrel to flow back across the deformation zone. Seals are included to prevent liquid from entering the annulus containing the sacrificial tube. Seals prevent flow from pressure on the interior bore or from the exterior of the tool. Sliding rod seals are mounted on the inner diameter of the housing and seal against the sliding mandrel.

In one advantageous embodiment, the sacrificial tube may be fabricated from an extrusion or casting that will allow for cost savings in volume. The design will allow for the desired cross-sectional features of the design with some finish machining being required on the tube ends and designed stress concentration features. The idealized material properties may be traded off against cost in making an optimal selection.

Tools can be designed in a variety of sizes to fit different applications. Within each basic tool size, adjustments can be made to the performance characteristics. The simplest change will be to have several interchangeable cutter ring options with different numbers of teeth or tooth geometry. Alternate tube materials or tube geometries will provide another interchangeable option. For example, the yield point or elongation at break of the tube can be selected to meet a desired performance. An example of a way to achieve this variation would be to have several different material types or even heat treat conditions as options.

Another example would be to vary the wall thickness or stress concentration geometry to change the force characteristics. The stroking length (i.e., compression length) of the tool can also be selected to optimize tool size for an application. If a modular design is used, multiple shock absorber tools can be stacked in series to provide a longer total stroke.

Materials used for mating surfaces under contact stress can be chosen to minimize galling risks such as by choosing one material to be significantly harder than the other. Lubricants may also be used to control friction. Specialized coatings may be used to enhance wear and friction properties, providing a high surface hardness or friction reduction, or both.

A shear set may be used to lock out the motion of the mechanical energy absorber until a predetermined load level is exceeded. Such loading results in shearing of the pins, allowing engagement of the teeth with the sacrificial tube.

Variation in the number of pins installed and the selection of the pin material can be used to select a specific critical load level.

A stopper is optionally included to minimize the impact energy should the mechanical energy absorber reach its full stroke capability. The relatively soft bronze or similar material will undergo significant deformation, reducing peak stresses in the mating components and reducing the initiation and transfer of shock loads. Ideally, the mechanical energy absorber will be configured for a given application such that it will not reach the stop during operation.

The exposed length of mandrel may be protected from wellbore fluids using protective coatings and/or a temporary sealed containment structure. The containment, such as a thin-walled sleeve, could be filled with oil and be pressure-balanced. The sleeve would only be functional prior to the stroking of the energy absorber. The sleeve would also aid in protecting the tool from casing contact during run-in which might damage or stroke the tool prematurely.

A key or similar feature may be used to transfer torsional loads from the housing to the mandrel to prevent relative rotation of the cutting elements and the sacrificial tube. Alternately, the sacrificial tube may be allowed to freely rotate within the housing while staying aligned with the cutting elements.

A secondary mechanical energy absorber may be used in series with a primary mechanical energy absorber. As a simple example, an elastomeric layer may be integrated to reduce peak shock or acceleration levels transferred. One or more of such layers would not function well as a primary absorber of mechanical energy, but can serve to attenuate peak levels in a complementary fashion. Alternating layers of disparate acoustic impedance may offer an optimal acoustic attenuation approach. An example of this approach is described in U.S. Pat. No. 5,188,191. However, the compliance of the elastomeric layers must not compromise the functionality of the primary mechanical energy absorber and thus a relatively thin layer of elastomeric material may be incorporated. The elastomer layer or layers could be incorporated as a separate tool section in series with the primary mechanical energy absorber tool.

Figure 18:
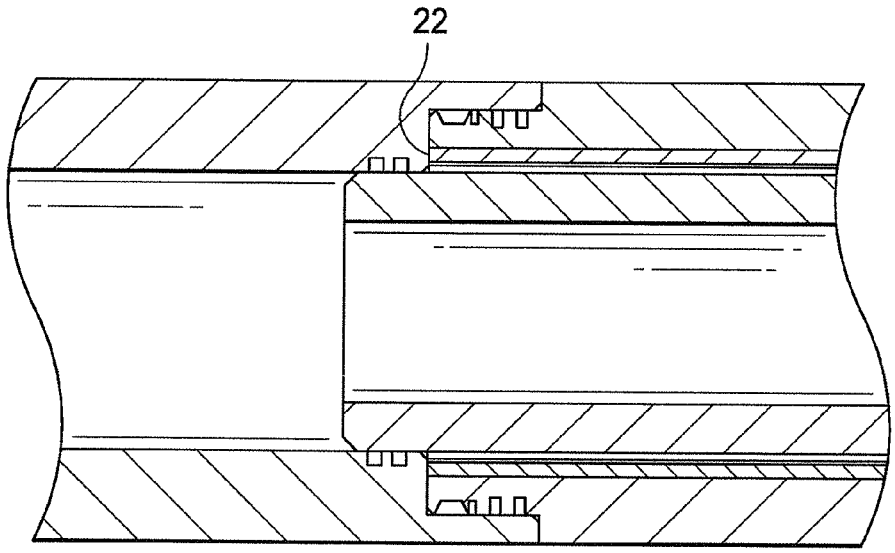
FIG. 18 illustrates a cross sectional view of the mechanical energy absorber tool of the present invention showing an elastomer ring between a sacrificial tube and a housing shoulder.

Alternatively, the elastomer layer can be incorporated as a ring in the interface between the sacrificial tube and the housing shoulder. This embodiment is illustrated in FIG. 18. A separate embodiment with a similar objective would have the elastomer surrounding the sacrificial tube in the housing and coupling the two via shear as the sole load path. The elastomer may be molded in place at elevated temperature. A third embodiment would locate the elastomer between the cutter ring and the mandrel, either in a compression ring or shear load transfer configuration.

If desired, the tool can be designed as a pressure-balanced system to eliminate the seals and pressure requirements on the housing strength. The inside of the tool would be filled with a low viscosity, high lubricity, clean oil, such as mineral oil or other fluid with advantageous properties. A pressure balance bellows or other similar mechanism would allow pressure to equalize between the wellbore and the inside of the tool, allowing for the compressibility of the selected fill fluid. Modifications can be made to the mandrel, sacrificial tube, and housing to enlarge bypass flow pathways to that fluid can transfer from in front of the cutting mandrel to the backside with a minimum of resistance. For example, the open space illustrated in FIG. 7 in the grooves on the outside of the sacrificial tube can be used as a flow bypass pathway.

In some applications, the system may allow for multiple uses without replacement of any components. For example, the mandrel may travel only through a part of the total allowable stroke. Upon evaluation of the remaining stroke, the tool may be run again in its current condition should sufficient available stroke remain.

In another advantageous embodiment, the tool may be designed such that the limit load is varied over the stroke if desired in certain applications. One example of this would be to have the load gradually increase, decrease, or vary continuously by tailoring the properties or geometry of the sacrificial tube along its length. A second example would utilize a segmented sacrificial tube, where each segment has different properties or geometry. A third example would have the mandrel engage secondary cutter rings to increase the effective number of teeth deforming the sacrificial tube during the stroke. Alternatively, a parallel load path may be engaged using a secondary mechanical energy absorber during part or all of the stroke of the device.

Simpler geometries for the mechanical energy absorber of the present invention may also provide continuous deformation and possible rupture. The tube geometry may be any closed section. The cutting teeth may be simplified to bosses at the cost of increased friction. The cutting teeth may be direct cutters that cut through the tube without applying a significant radial force. The closed section of the tube may be forced to reduce in circumference and buckle inward locally in a controlled manner. The tube may be replaced by one or more strips or open sections that are forced through a deformation process that causes localized bending and/or shearing within the cross section.

Figure 19:
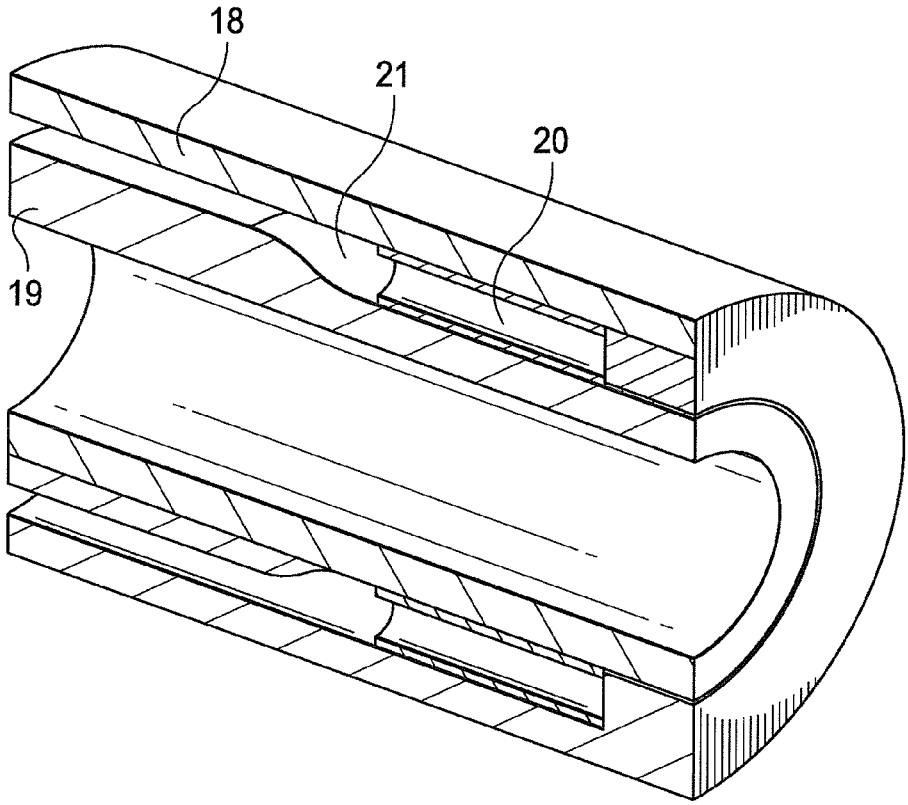
FIG. 19 illustrates a conceptual drawing of a second advantageous embodiment of the invention shown in longitudinal section.

Referring now to FIG. 19, a second advantageous embodiment of the invention operates in a similar manner but with a modification to the geometry of the deforming and deformable elements. The deformable element consists of axially-oriented tubes 20 arrayed in the annular space between an inner deforming element or mandrel 19 and outer housing 18. Each tube in the array makes a line contact with the mandrel 19 and deforms locally and continuously during the stroke of the device. The mandrel 19 consists of a small diameter leading section and a larger diameter trailing section with a conical transition 21 in between. The leading section is sized to make contact with the tube array 20 to centralize the mandrel 19 and support the tubes. The maximum diameter of the mandrel 19 determined the maximum radial deformation of the annular array. The trailing diameter provides additional support to the deformed tubes and additional centralization of the mandrel 19. The transition geometry of the cone 21 including leading and trailing angle and external transition radius can be chosen to optimize the deformation of the deformable array of tubes.

Figure 20:
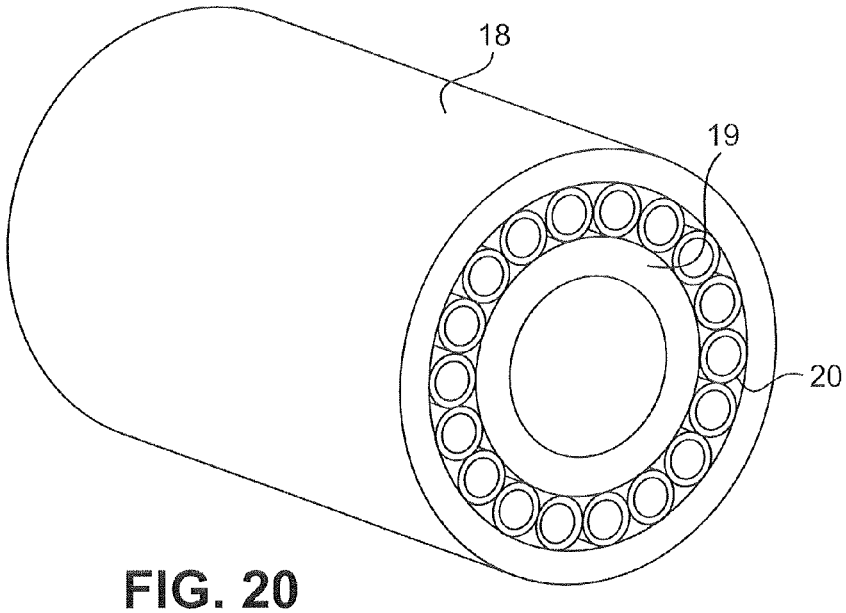
FIG. 20 illustrates a conceptual drawing of the second advantageous embodiment of the invention shown in transverse section.

Referring now to FIG. 20, a transverse section view through the housing 18, annular array of tubes 20, and mandrel 19 is shown forward of the conical transition.

The array of tubes illustrated here a simple example of an unlimited number of possible deformable element options. Various closed or open-section tubes offer a low-cost option for selecting a desired resistance load and energy absorption per unit stroke length. The array may be formed from completely separate elements or may be joined via welding or a carrier frame. The array may be a combination of different types of elements having various material properties and geometries. As with the first advantageous embodiment, the array of the second advantageous embodiment could also be formed from a custom extrusion or casting.

Many of the same advantages and alternate embodiments as described for the primary embodiment also apply to this second embodiment and are not repeated here for brevity.

The energy absorbed by a mechanical energy absorber is a function of the force and stroke of the device. A plot of the force versus stroke for the device during operation can be used to calculate the energy absorbed from the area under the curve. An impact event will provide a certain energy input to a system. Without the mechanical energy absorber, that energy would be transferred to the system in a rather short timespan and with very high peak acceleration and loading. The mechanical energy absorber functions to convert the energy transfer from a short duration, high-amplitude event into a longer duration, constant-amplitude event. The energy is essentially spread out over time and over the stroke of the device. As a result, the impacted system is subjected to much lower acceleration and force levels.

The situation is somewhat different for perforating applications where the blast energy excites the tool string structure over an extensive length. In this case, the energy absorber and load limiter may advantageously provide a "soft" boundary within the tool string. While absorbing energy, the device also allows for local displacement and thus modifies the complex dynamic behavior of the system. This approach can be used to reduce stresses and loads across a length of the tool string including within the perforating guns themselves.

When metals yield, deform plastically or inelastically, mechanical energy is converted into rearranging the structure of the material and creating heat. Energy is absorbed in the process. Similarly, when a metal ruptures or tears, energy is also absorbed in the breaking of the bonds of the metal lattice. The stress versus strain plot for a given metal describes its yield behavior and eventual failure. The area under the curve represents the specific energy absorbed if the material is loaded to failure. Note that this curve may be strain rate-dependent. Metals for the sacrificial tube may be chosen to have a desired combination of yield strength and elongation to break to maximize the specific energy absorbed. This metric must be traded off with the wear performance of the cutting teeth as they progress through the material.

Figure 21:
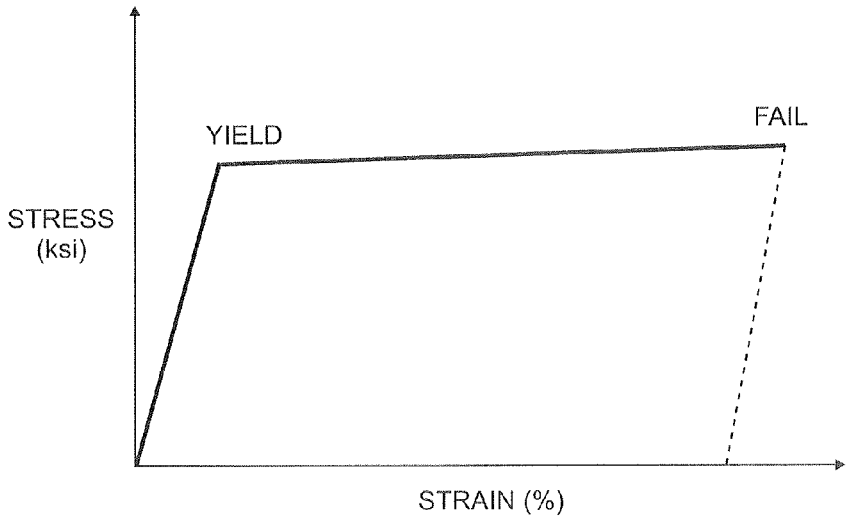
FIG. 21 illustrates a simplified representation of metal stress-strain curve to failure.

FIG. 21 illustrates a typical stress-strain curve for a metallic material. Starting from the origin with zero load and stroke, the material is first loaded and deforms elastically up to the point of yield. Above the yield point, the slope of the curve becomes much lower as plastic deformation occurs. This continues up to the point of failure. Upon failure, the load is reduced to zero and elastic deformation is reversed. The exact shape of this curve varies greatly for different materials and conditions. The area under the curve is a measure of the specific energy or energy per unit volume that is absorbed in the plastic deformation of the material.

Figure 22:
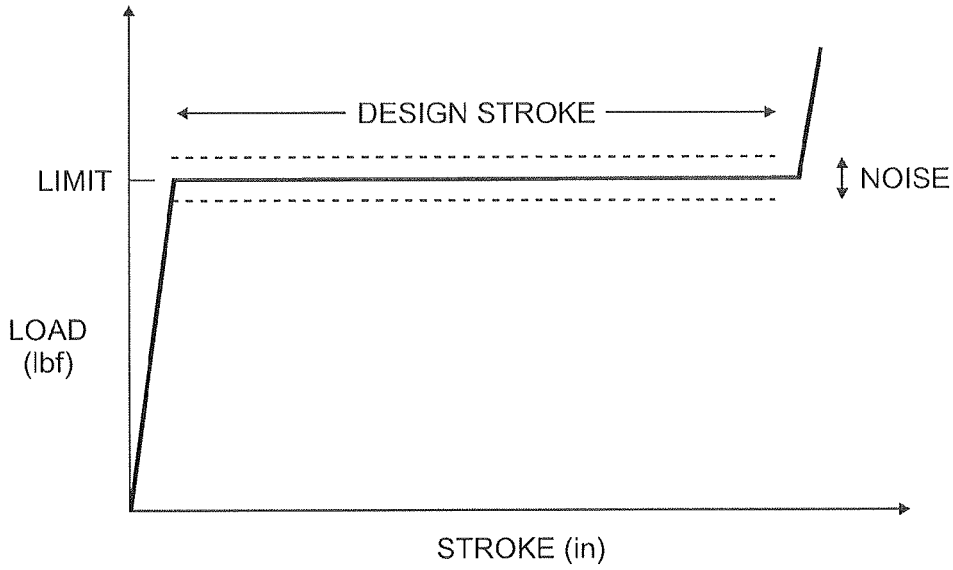
FIG. 22 illustrates a simplified representation of mechanical energy absorber performance.

FIG. 22 illustrates a load-stroke diagram illustrating the general behavior of a load-limiting or constant-load shock absorber. After an initial load increase to the limit load, the load remains relatively constant over an extended stroke. The load may vary over this range but stays within some noise level. The amount of material deforming inelastically in the cross section of the shock absorber determines the limit load. Finally, at the end of the designed stroke, the absorber reaches stops that engage a stiffer load path, rapidly increasing the load for any additional stroke. The length of the deformable and deforming elements sets the design stroke. The area under this curve represents the total energy absorbed by the device. The load and stroke may be traded to achieve a particular energy absorption requirement. Constraints on maximum load and maximum stroke will also drive the design.

A SOLIDWORKS® 3-dimensional solid model was developed for the mechanical energy absorber tool of the present invention. SOLIDWORKS® is a trademark of SolidWorks Corporation. The model enables the fit of the various components to be checked and for drawings to be generated for fabrication of parts. The model also allows for adaptations to the design to be made for meeting modified application requirements.

LS-DYNA® explicit finite element software was used to simulate the performance of the mechanical energy absorber. LS-DYNA® is a trademark of Livermore Software Technology Corporation. Based on the symmetry of the system, a ten (10) degree sector model spanning from the midplane between two teeth to the plane through the center of a tooth was used. The mandrel was driven with either constant force or constant velocity and the resulting motion, deformation, and stresses were predicted. Results are included in the figures for the constant velocity case at one hundred feet per second (100 ft/sec). The half-tooth travels through a four inch (4") length of tubing before exiting. The tooth is a hardened tool steel with 180 ksi yield strength while the tube is a mild steel with 50 ksi yield strength.

Figure 23:
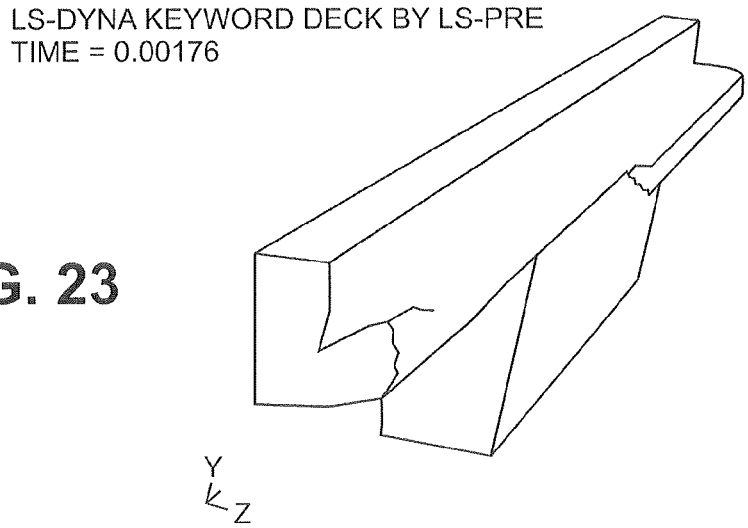
FIG. 23 illustrates a LS-DYNA® model of a ten degree sector of a cutting element engaging a sacrificial tube showing tube deformation as the cutting element moves.
Figure 24:
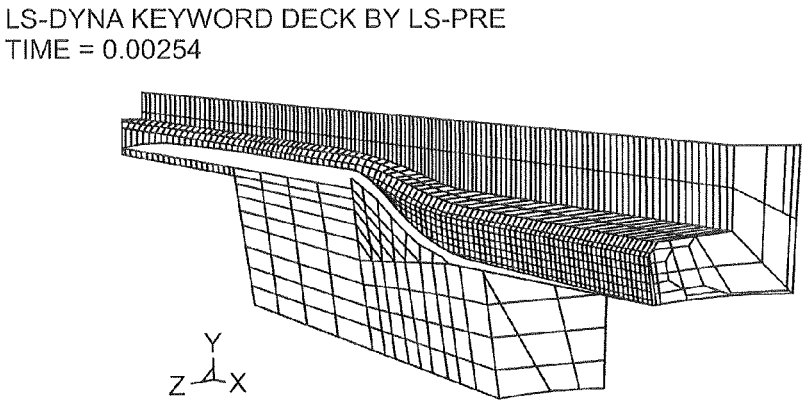
FIG. 24 illustrates a LS-DYNA® model showing deformation as a cutting element moves through a sacrificial tube.

The deformation, stress distribution, and plastic strain distribution illustrate the local absorption of energy as the cutter traverses the sacrificial tube. FIGS. 23 through 28 illustrate the simulation results. The sacrificial tube consists of webs joining longitudinal ribs. The webs are split by the cutting teeth. Each web segment is forced radially outward to the point of rupture. FIGS. 23 and 24 provide two views of this deformation behavior. The rupture plane is on the symmetry plane of the model slice. The ribs provide stiffness to the sacrificial tube and contact support from the pressure housing while allowing adequate space for the web to deform. Energy is absorbed not only along the plane of rupture, but also throughout most of the web where permanent bending deformation occurs. The minimal elastic recovery of the deformed web results in inward radial motion and does not impart any substantial axial force or motion on the mandrel.

Figure 25:
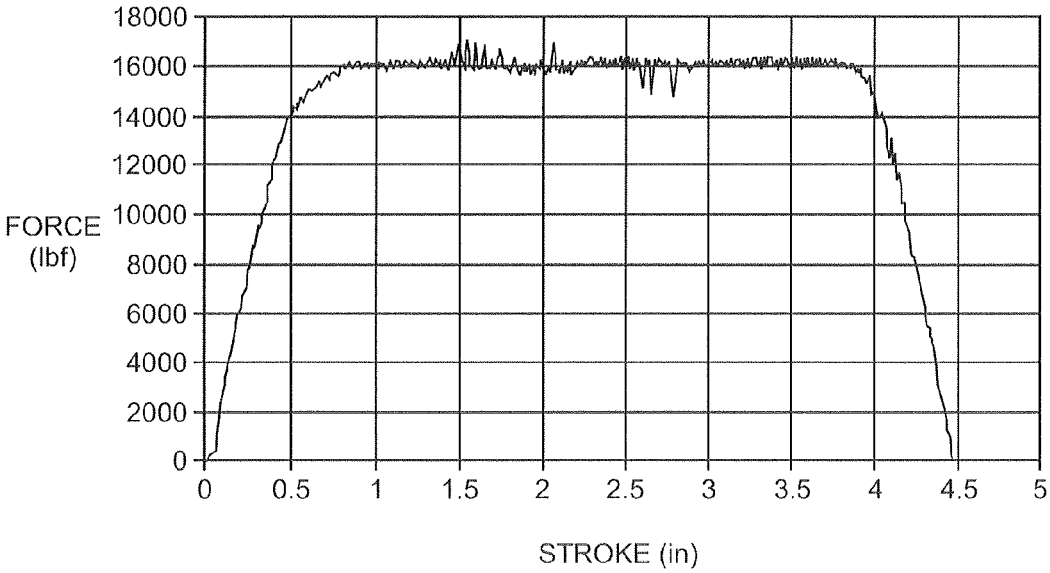
FIG. 25 illustrates a graph showing a force versus stroke simulation for cutting ring moving through a four inch (4") length of tube at a constant speed of one hundred feet per second (100 ft/sec)
Figure 26:
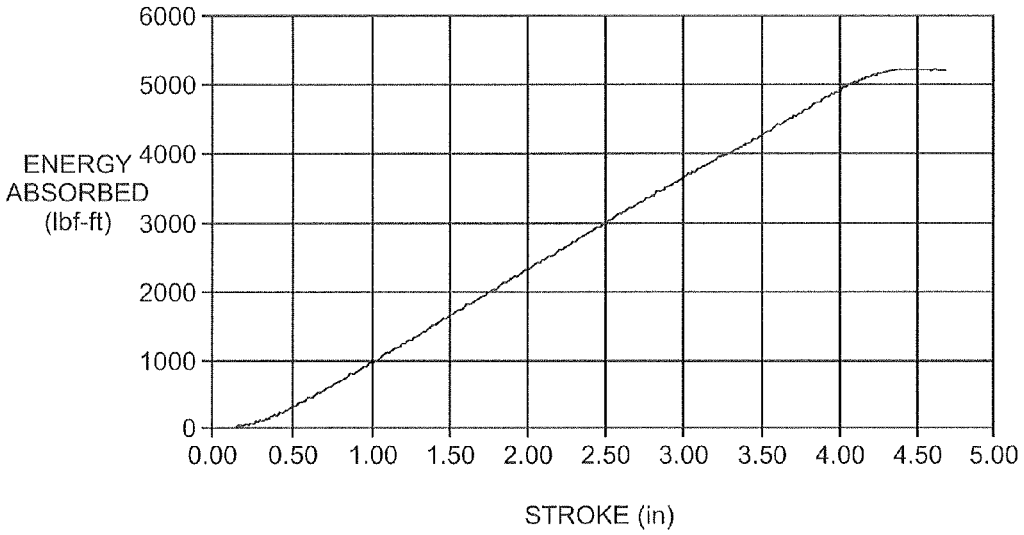
FIG. 26 illustrates a graph showing energy absorption versus stroke simulation for s cutting ring moving through a four inch (4") length of tube at a constant speed of one hundred feet per second (100 ft/sec)

The simulation results in FIG. 25 show a gradual ramp up followed by a relatively constant load. The area under the curve represents the energy absorbed during the stroke. The load is shown for a full three hundred sixty degree)(360° assembly (eighteen (18) teeth) and reaches a constant load level of sixteen thousand pounds (16,000 lbs) through the stroke. The energy absorbed in FIG. 26 is also shown for a full assembly cutting through four inches (4") of length and absorbing five thousand two hundred foot pounds (5,200 ft-lbs).

Figure 27:
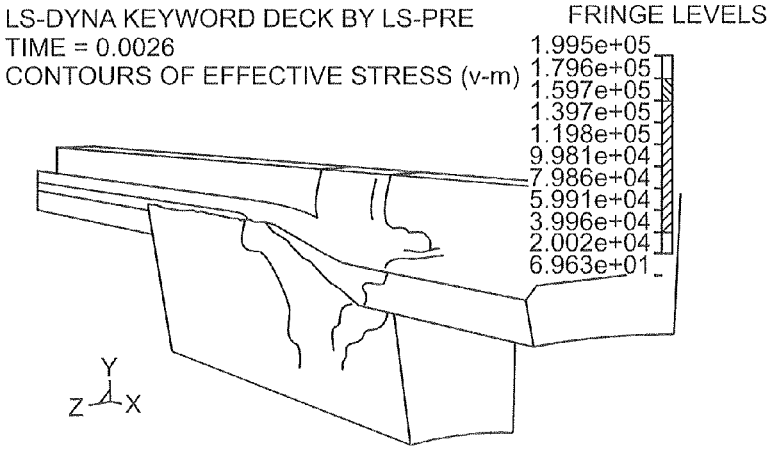
FIG. 27 illustrates a LS-DYNA® model showing a Von Mises stress distribution in a mechanical energy absorber tool of the present invention.
Figure 28:
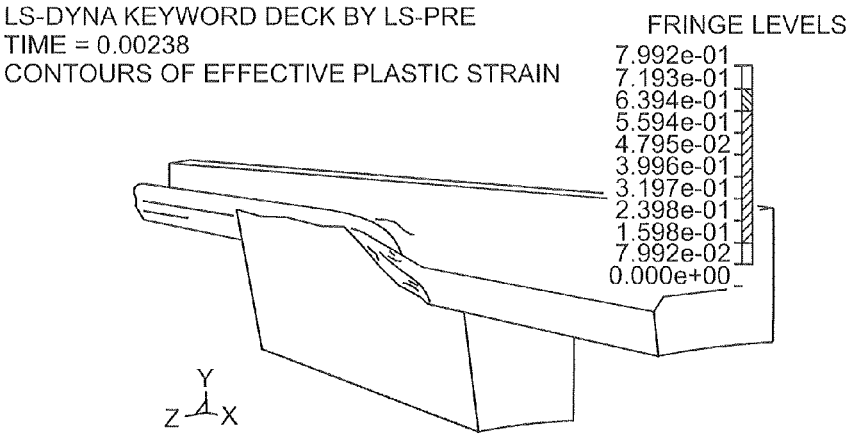
FIG. 28 illustrates a LS-DYNA® model showing a plastic strain distribution in a mechanical energy absorber tool of the present invention.

The stress distribution during deformation is illustrated in FIG. 27. The peak stress is distributed along the leading edge of the cutting element. The plastic strain distribution in FIG. 28 indicates the large area of inelastic deformation extending across the web of the sacrificial tube as it is deformed by the cutting element.

A second LS-DYNA® analysis was performed on a representative downhole tool string affected by a load pulse. A tool string was modeled that consisted of one hundred feet (100 ft) of tubing hung from a packer and one hundred sixty feet (160 ft) of perforating guns below. A shock absorber was inserted between the tubing and the guns. A representative triangular load pulse was applied to the bottom of the string superimposed on a hydrostatic pressure load. Such a load could represent a simplified detonation event or a tool string impact with a fixed object during the run into the well. The pulse was ten milliseconds (10 msec) wide and had a five hundred thousand pound-foot (500,000 lbf) peak amplitude and acted upwardly so as to compress the string. The shock absorber simulated a rapid linear ramp up to a one hundred fifty thousand pound (150,000 lbf) limit load in both tension and compression. A full dynamic simulation of the tool string response was run to compare strings with the shock absorber engaged and with it locked out so that it could not stroke.

Figure 29:
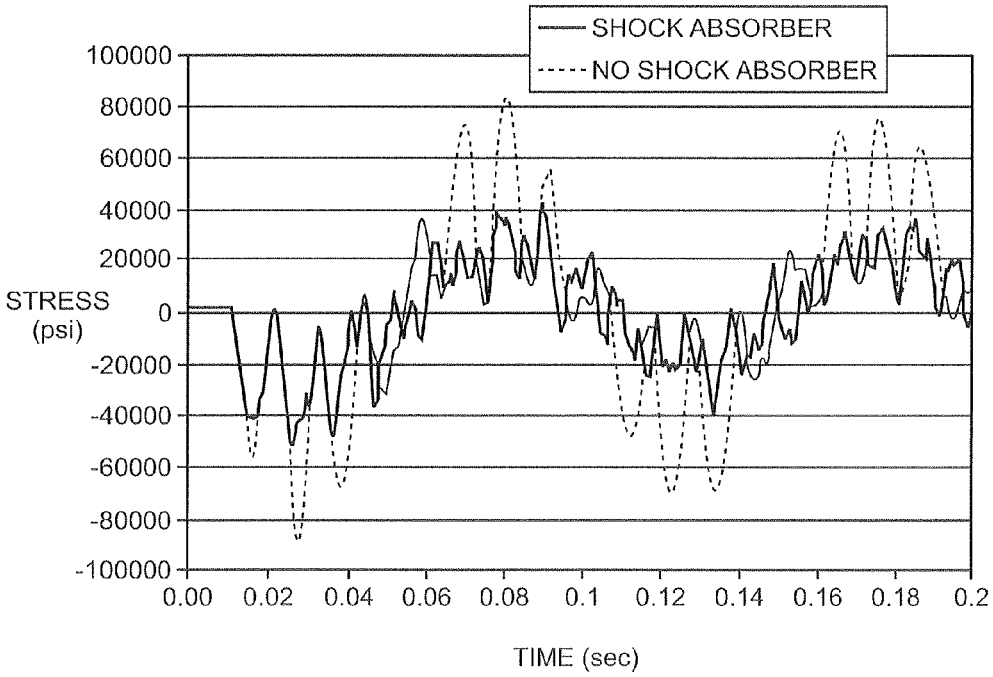
FIG. 29 illustrates a LS-DYNA® simulation comparison illustrating tool string load reduction using an energy absorber.

The stresses and loads in the tool string were compared for simulations with and without the shock absorber. Referring to FIG. 29, time histories of the simulated tool string responses are presented. In this figure the stress in the tubing immediately above the shock absorber is plotted for the two configurations. The results indicate a fifty percent (50%) reduction in the peak stress predicted in the tubing above the shock absorber. In addition, a sixty six percent (66%) reduction was measured in the peak stresses immediately below the shock absorber and an average twenty five percent (25%) reduction in loads was predicted across the entire string of perforating guns.

It should be noted that these analyses were performed as a simple example of the potential performance for the proposed energy absorber designs and in no way limits the range of possible design parameters or downhole applications. A key advantage of the proposed embodiments is the ease of adjusting the limit load and stroke to optimize performance for a particular tool string configuration and anticipated loading environment. Modern analysis tools enable the tool string designer to determine the best configuration for the shock absorber or shock absorbers and their placement in the tool string or wellbore for a particular job. This example illustrates the benefits of a design without any attempt to optimize.

Although the present invention has been described with an exemplary embodiment, various changes and modifications may be suggested to one skilled in the art. It is intended that the present invention encompass such changes and modifications as fall within the scope of the appended claims.

What is claimed is:

1. A downhole apparatus that absorbs mechanical energy comprising:

a first tubular member comprising a plurality of axially oriented strips;

a second tubular member slidably positioned relative to and coaxial with the first tubular member; and a plurality of radial members extending from the second tubular member such that relative movement of the second tubular member with respect to the first tubular member causes localized deformation of the first tubular member in a continuous fashion, thereby absorbing mechanical energy.

2. An apparatus as claimed in claim 1 wherein the deformation of the first tubular member causes a rupture of a material of the first tubular member.

3. An apparatus as claimed in claim 1 wherein the first tubular member comprises at least one stress concentration feature.

4. An apparatus as claimed in claim 1 wherein the second tubular member comprises a cutting element that deforms the first tubular member.

5. An apparatus as claimed in claim 4 wherein the second tubular member is disposed within the first tubular member.

6. An apparatus as claimed in claim 1 wherein the second tubular member is disposed within the first tubular member.

7. An apparatus as claimed in claim 1 wherein a tubular member cross section of the first and second tubular members comprises a circle.

8. An apparatus as claimed in claim 1 wherein the plurality of axially oriented strips are mechanically joined.

9. An apparatus as claimed in claim 1 wherein the second tubular member is discontinuous around its perimeter.

10. An apparatus as claimed in claim 1 wherein the first tubular member comprises a metal with high ductility.

11. An apparatus as claimed in claim 1 wherein a material of the second tubular member comprises hardened steel.

12. An apparatus as claimed in claim 1 further comprising one of: a lubricant that reduces friction and a coating that reduces friction.

13. An apparatus as claimed in claim 1 comprising a shear pin mechanism that locks out a movement between the first tubular member and the second tubular member until a minimum activation load has been reached.

14. An apparatus as claimed in claim 1 wherein a lock-out of the movement between the first tubular member and the second tubular member is deactivated via communication from a downhole tool.

15. An apparatus as claimed in claim 1 wherein a lock-out of the movement between the first tubular member and the second tubular member is deactivated under a prescribed wellbore condition that comprises at least one of: a time condition, a temperature condition, a pressure condition and an acceleration condition.

16. An apparatus as claimed in claim 1 comprising a frangible element that deactivates a lock-out of a movement between the first tubular member and the second tubular member.

17. An apparatus as claimed in claim 1 wherein the apparatus is positioned in a fixed wellbore location.

18. An apparatus as claimed in claim 1 wherein the mechanical energy is absorbed in compression.

19. An apparatus as claimed in claim 1 wherein the mechanical energy is absorbed in tension.

20. An apparatus as claimed in claim 1 wherein the mechanical energy is absorbed in compression and in tension.

21. An apparatus as claimed in claim 1 further comprising a locking mechanism that prevents a reverse motion of the first tubular member relative to the second tubular member.

22. An apparatus as claimed in claim 1, the apparatus comprising a first apparatus configured to be coupled to at least one second downhole apparatus that absorbs mechanical energy, wherein the first and second downhole apparatuses are stacked with respect to a common mandrel that increases a total energy absorbed per unit length of stroke.

23. An apparatus for absorbing mechanical energy in a downhole location, the apparatus comprising:

a first tubular member disposed in said downhole location, the first tubular member comprising a plurality of axially oriented strips;

a second tubular member slidably positioned within the first tubular member; and a plurality of radial members extending from the second tubular member such that movement of the second tubular member in a first direction relative to the first tubular member causes localized inelastic deformation of the first tubular member in a continuous fashion, thereby absorbing the mechanical energy.

24. A downhole tool assembly comprising:

a perforating gun; and a mechanical energy absorber that comprises:

a first tubular member disposed in a downhole location, the first tubular member comprising a plurality of axially oriented strips;

a second tubular member slidably positioned relative to and coaxial with the first tubular member; and a plurality of radial members extending from the second tubular member such that movement of the second tubular member in a first direction relative to the first tubular member causes localized inelastic deformation of the first tubular member in a continuous fashion, thereby absorbing mechanical energy.

25. An apparatus as claimed in claim 24 wherein the load during deformation remains within ten percent of a constant level.

26. A downhole tool assembly comprising:

a downhole tool; and a mechanical energy absorber that comprises:

a first tubular member disposed in a downhole location, the first tubular member comprising a plurality of axially oriented strips;

a second tubular member slidably positioned relative to and coaxial with the first tubular member; and a plurality of radial members extending from the second tubular member such that movement of the second tubular member in a first direction relative to the first tubular member causes localized inelastic deformation of the first tubular member in a continuous fashion, thereby absorbing mechanical energy.

27. An apparatus for absorbing a mechanical shock downhole comprising:

a first tubular member disposed in a downhole location, the first tubular member comprising a plurality of axially oriented strips;

a second tubular member slidably positioned relative to and coaxial with the first tubular member; and a plurality of features on the second tubular member such that movement of the second tubular member in a first direction relative to the first tubular member causes inelastic deformation of the first tubular member, thereby absorbing mechanical energy.

28. An apparatus for absorbing mechanical energy downhole comprising:

a first deformable member in a downhole location, the first deformable member comprising a plurality of axially oriented strips; and a second member in a downhole location positioned to interfere with the first deformable member during relative axial motion of the first deformable member and the second member, the second member comprising a plurality of radially extending protrusions;

wherein an imparted mechanical load forces the second member to travel relative to first deformable member causing continuous localized inelastic deformation of the first deformable member to absorb mechanical energy.

29. An apparatus for absorbing mechanical energy downhole, the apparatus comprising:

a housing;

an annular array of axially oriented members within the housing, the array of axially oriented members comprises an array of closed section tubes; and an inner tubular member slidably positioned relative to and coaxial with the annular array members;

wherein the movement of the inner tubular member in a first direction relative to the array of axially oriented members causes localized inelastic deformation of the array of axially oriented members in a continuous fashion, thereby absorbing mechanical energy.

30. A method of absorbing mechanical energy in a downhole location, the method comprising the steps of:

slidably positioning a first tubular member relative to a second tubular member in a downhole location, the first tubular member comprising a plurality of axially oriented strips, the second tubular member comprising a plurality of radially extending protrusions; and continuously locally deforming and rupturing the first tubular member as the second tubular member is moved in a first direction relative to the first tubular member, thereby absorbing mechanical energy.

31. A method of absorbing mechanical energy in a downhole location, the method comprising the steps of:

placing a mechanical energy absorber in the downhole location; and continuously applying localized inelastic deformation to a first member of the mechanical energy absorber as the first member is slidably moved relative to a second member of the mechanical energy absorber, the first member comprising a plurality of axially oriented strips, the second member comprising a plurality of radially extending protrusions.

32. A method of absorbing mechanical energy in a downhole location, the method comprising the steps of:

placing a mechanical energy absorber in the downhole location, the mechanical energy absorber comprising a first deformable member and a second member having a plurality of radially extending protrusions; and continuously applying inelastic deformation to the first deformable member of the mechanical energy absorber by slidably moving a second member relative to the first deformable member, the first deformable member comprising a plurality of axially oriented strips.

33. A method for absorbing mechanical energy in a downhole location, the method comprising the steps of:

placing a mechanical energy absorber in the downhole location, the mechanical energy absorber comprising a plurality of axially oriented strips; and inelastically deforming the mechanical energy absorber by slidably moving a cutting ring relative to the mechanical energy absorber, the cutting ring having a plurality of radially extending protrusions, wherein said mechanical energy absorber provides a near-constant force during deformation.

34. An apparatus that absorbs mechanical energy comprising:

a first tubular member comprising a plurality of axially oriented strips; and a second tubular member slidably positioned relative to and coaxial with the first tubular member, the second tubular member comprising a plurality of radially extending protrusions;

wherein the movement of the second tubular member in a first direction relative to the first tubular member causes localized inelastic deformation of the first tubular member in a continuous fashion, thereby absorbing mechanical energy.

35. An apparatus that absorbs mechanical energy downhole comprising:

a housing;

an annular array of axially oriented members within the housing, the array of axially oriented members comprises an array of open section tubes; and an inner tubular member slidably positioned relative to and coaxial with the annular array members;

wherein the movement of the inner tubular member in a first direction relative to the array of axially oriented members causes localized inelastic deformation of the array of axially oriented members in a continuous fashion, thereby absorbing mechanical energy.

36. An apparatus as claimed in claim 35 wherein the array of axially oriented members comprises members that are joined.

37. An apparatus as claimed in claim 35 wherein the inner tubular member utilizes an external conical surface to engage the deformable array of axially oriented members.

38. An apparatus as claimed in claim 35 wherein the deformable array of axially oriented members is compressed radially.

39. An apparatus as claimed in claim 35 wherein the deformable array of axially oriented members comprises one of: a plurality of material types and a plurality of types of geometry.

40. An apparatus as claimed in claim 35 wherein a relative movement of the inner tubular member and the housing is locked out with a shear pin mechanism.

41. An apparatus as claimed in claim 35 comprising an annular array geometry that is circular.

42. An apparatus as claimed in claim 41 wherein the array of axially oriented members comprises one of: beams and strips.

43. An apparatus as claimed in claim 35 wherein the array of axially oriented members comprises one of: beams and strips.

44. An apparatus as claimed in claim 35 wherein a plurality of arrays are stacked with corresponding deforming elements moving together to increase an energy that is absorbed per unit length of stroke.

45. An apparatus as claimed in claim 35 further comprising a locking mechanism that prevents reverse motion.

46. A method of controlling a dynamic response of a stationary downhole tool string, the method comprising the steps of:

placing an energy absorbing device downhole as part of a tool string, the device comprising a first deformable member having a plurality of axially oriented strips and a second member having a plurality of radially extending protrusions:

sliding the second member relative to the first deformable member; and causing the device to stroke at a preset constant load.

47. A method of reducing stationary tool string stresses in response to dynamic loading, the method comprising the steps of:

placing an energy absorbing device downhole as part of a tool string, the device comprising a first deformable member having a plurality of axially oriented strips and a second member having a plurality of radially extending protrusions;

sliding the second member relative to the first deformable member;

reaching a preset load; and reducing an effective stiffness and stroking the device when the preset load is reached.

48. An apparatus that absorbs mechanical energy downhole comprising:

a housing;

a first tubular member within the housing, the first tubular member comprising a plurality of axially oriented strips;

a second tubular member slidably positioned relative to and coaxial with the first tubular member; and a plurality of radial members extending from the second tubular member such that a movement of the second tubular member in a first direction relative to the housing causes deformation of the first tubular member in a continuous fashion, thereby absorbing mechanical energy.

49. A method of protecting a downhole tool string from dynamic loading events, the method comprising:

placing one or more energy absorbers within a tool string such that at least one of the energy absorbers strokes at a preset limit load, wherein at least one of the energy absorbers comprises a first deformable member having a plurality of axially oriented strips and a second member having a plurality of radially extending protrusions; and sliding the second member relative to the first deformable member.

* * * * *